US010268162B2

(12) United States Patent
Iri et al.

(10) Patent No.: US 10,268,162 B2
(45) Date of Patent: Apr. 23, 2019

(54) ELECTRONIC WATCH

(71) Applicants: CITIZEN HOLDINGS CO., LTD., Tokyo (JP); CITIZEN WATCH CO., LTD., Tokyo (JP)

(72) Inventors: Daisuke Iri, Nishitokyo (JP); Yu Takyo, Nishitokyo (JP)

(73) Assignee: CITIZEN WATCH CO., LTD., Tokyo (JP)

( * ) Notice: Subject to any disclaimer, the term of this patent is extended or adjusted under 35 U.S.C. 154(b) by 442 days.

(21) Appl. No.: 15/126,581

(22) PCT Filed: Mar. 9, 2015

(86) PCT No.: PCT/JP2015/056854
§ 371 (c)(1),
(2) Date: Sep. 15, 2016

(87) PCT Pub. No.: WO2015/141511
PCT Pub. Date: Sep. 24, 2015

(65) Prior Publication Data

US 2017/0322518 A1 Nov. 9, 2017

(30) Foreign Application Priority Data

Mar. 17, 2014 (JP) ..... 2014-053282

(51) Int. Cl.
*G04C 3/14* (2006.01)
*G04G 19/12* (2006.01)

(52) U.S. Cl.
CPC ..... *G04C 3/143* (2013.01); *G04G 19/12* (2013.01)

(58) Field of Classification Search
CPC ... G04C 3/143; H02P 8/02; H02P 8/38; H02P 8/34; H02P 8/16
See application file for complete search history.

(56) References Cited

U.S. PATENT DOCUMENTS 6,137,252 A * 10/2000 Kojima ..... G04C 3/143 318/586
6,163,126 A 12/2000 Kojima et al.
(Continued)

FOREIGN PATENT DOCUMENTS

CN 1241323 A 1/2000
CN 101841294 A 9/2010
(Continued)

OTHER PUBLICATIONS

Search Report dated Sep. 15, 2017, for corresponding EP Patent Application No. 15764232.3.
(Continued)

*Primary Examiner* — Shawki S Ismail
*Assistant Examiner* — Zoheb S Imtiaz
(74) *Attorney, Agent, or Firm* — HEA Law PLLC

(57) ABSTRACT

Provided is an electronic watch which achieves a highest-speed fast-forward operation of a step motor based on various environments under which the watch is placed, and enables low-power driving. The electronic watch includes: a normal pulse generator circuit configured to output a normal pulse SP for driving a step motor; a detection pulse generator circuit configured to output, after the step motor has been driven with the normal pulse SP, detection pulses DP1 and DP2 for detecting whether or not the step motor has been rotated; a pulse selection circuit configured to selectively output the normal pulse SP and the detection pulses DP1 and DP2; a rotation detector circuit configured to input detection signals DS1 and DS2 generated from the detection pulses DP1 and DP2, and to determine whether or not the step motor has been rotated; and a frequency selection circuit configured to determine a driving interval of the normal pulse SP, in which the rotation detector circuit is configured to instruct the frequency selection circuit to select a fre-
(Continued)

quency corresponding to a position at which the detection signals DS1 and DS2 have been generated.

15 Claims, 24 Drawing Sheets

(56) References Cited

U.S. PATENT DOCUMENTS

| | | | | |
|---|---|---|---|---|
| 6,843,594 | B1 | 1/2005 | Moteki et al. | |
| 2001/0030908 | A1 | 10/2001 | Moteki et al. | |
| 2008/0089183 | A1* | 4/2008 | Manaka | G04C 3/143 368/202 |
| 2010/0149924 | A1* | 6/2010 | Ogasawara | B60L 15/2009 368/80 |
| 2010/0238768 | A1 | 9/2010 | Kato et al. | |
| 2011/0080132 | A1* | 4/2011 | Ogasawara | H02P 8/38 318/696 |
| 2012/0204640 | A1* | 8/2012 | Takyo | G04C 3/143 73/504.04 |

FOREIGN PATENT DOCUMENTS

| | | | |
|---|---|---|---|
| CN | 102576215 | A | 7/2012 |
| EP | 2487549 | A1 | 8/2012 |
| JP | 3757421 | B2 | 3/2006 |
| JP | 2010-164461 | A | 7/2010 |
| JP | 2010-243473 | A | 10/2010 |
| JP | 2011-247796 | A | 12/2011 |
| WO | 2008004605 | A1 | 1/2008 |

OTHER PUBLICATIONS

English translation of the International Search Report for PCT/JP2015/056854 dated Jun. 9, 2015.

* cited by examiner (a)

(b)

( a)

( b)

(c)

( a)

( b)

( a)

(b)

( a)

(b)

ELECTRONIC WATCH

CROSS REFERENCE TO RELATED APPLICATIONS

This application is a National Stage of International Application No. PCT/JP2015/056854 filed on Mar. 9, 2015. The contents of the above document is incorporated herein by reference in its entirety.

TECHNICAL FIELD

The present invention relates to an electronic watch configured to drive hands thereof with a step motor, and more particularly, to an electronic watch including fast-forward means for a step motor.

BACKGROUND ART

Hitherto, an electronic watch including an analog display means is generally configured to drive hands thereof with a step motor (also referred to as "stepping motor" or "pulse motor"). The step motor is formed of a stator to be magnetized by a coil and a rotor being a disc-shaped rotary body subjected to bipolar magnetization, and is generally involved in a fast-forward operation for moving the hands at high speed for time correction or the like as well as normal hand movement for driving the hands every second.

In the fast-forward operation, a driving pulse is supplied to the step motor with a short cycle period, but the step motor needs to operate without causing an error in the hand movement, that is, a rotation error of the rotor in response to the driving pulse for the fast forwarding with a short cycle period. Therefore, it is proposed to detect a rotation state of the rotor and supply an appropriate driving pulse based on the rotation state, to thereby carry out the fast-forward operation with stability (see, for example, PTL 1).

In PTL 1, in the driving of the step motor, assuming that reverse induced power excited by rotation of the rotor is a current or a voltage, the first peak thereof is detected, and the driving pulse is supplied while presence or absence of the rotation of the rotor keeps being verified based on the detection, to thereby achieve the fast-forward operation. Further, in PTL 1, in order to prevent an influence of spike noise ascribable to the driving pulse, there is disclosed setting an insensitive time period (mask time period) for inhibiting the reverse induced power from being detected for a predetermined time period from an output timing of the previous driving pulse, to thereby optimize a detection timing.

CITATION LIST

Patent Literature

[PTL 1] JP 3757421 A (Page 10, FIG. 5)

SUMMARY OF INVENTION

Technical Problem

However, the technology disclosed in PTL 1 involves only one detection condition for detecting reverse induced power excited by rotation of a rotor, and is therefore unable to detect fluctuations in a detected waveform (that is, rotation fluctuations of the rotor) with high accuracy. Therefore, when the rotation of the rotor becomes unstable due to a disturbance in an external magnetic field or the like, a rotation state of the rotor cannot be grasped accurately, and hence appropriate fast-forward driving cannot be conducted, which makes it difficult to speed up a fast-forward operation. Further, in the fast-forward operation, the supply of more driving power than necessary to the step motor leads to shorter battery life of an electronic watch. However, related-art detection means cannot detect rotation with high accuracy, and hence the driving power cannot be optimized, which also raises a problem in that low-power driving is difficult.

The present invention has an object to provide an electronic watch which solves the above-mentioned problems, achieves a highest-speed fast-forward operation of a step motor based on various environments under which the watch is placed, and enables low-power driving.

Solution to Problem

In order to solve the above-mentioned problems, an electronic watch according to one embodiment of the present invention employs the following configurations.

An electronic watch according to one embodiment of the present invention includes: a step motor; a normal pulse generator circuit configured to output a normal pulse for driving the step motor; a detection pulse generator circuit configured to output, after the step motor has been driven with the normal pulse, a detection pulse for detecting whether or not the step motor has been rotated; a pulse selection circuit configured to selectively output the normal pulse and the detection pulse; a driver circuit configured to load a pulse output from the pulse selection circuit on the step motor; a rotation detector circuit configured to input a detection signal generated from the detection pulse, and to determine whether or not the step motor has been rotated; and a frequency selection circuit configured to determine a driving interval of the normal pulse, in which: the detection pulse generator circuit is configured to output the detection pulse so as to divide the detection pulse into predetermined segments; and the rotation detector circuit is configured to conduct detection separately in each of detection segments corresponding to the predetermined segments, and to instruct the frequency selection circuit to select a frequency corresponding to the detection segment in which the detection signal has been detected.

Further, the rotation detector circuit is configured to conduct the detection separately in each of a plurality of the detection segments, and to change a detection condition for one of the detection segments based on a detection result of another one of the detection segments.

Further, the detection condition for the detection segment includes at least any one of a segment width of the detection segment or a number of detection signals to be detected within the detection segment.

Further, the normal pulse generator circuit is configured to be able to output a plurality of the normal pulses having different driving forces; and the rotation detector circuit is configured to select the normal pulse based on a determination result as to whether or not the step motor has been rotated, and to instruct the normal pulse generator circuit on a selection thereof.

Further, the rotation detector circuit is configured to instruct the frequency selection circuit on the frequency corresponding to the normal pulse that has been selected and instructed.

Further, the rotation detector circuit is configured to change a detection condition within each of the detection segments so as to correspond to the normal pulse that has been selected and instructed.

Further, the electronic watch further includes a frequency counting circuit configured to count a number of outputs of the normal pulse, in which the rotation detector circuit is configured to select, when the number of outputs of the normal pulse having a specific driving force has reached a predetermined number, the driving force so as to change the specific driving force of the specific normal pulse.

The rotation detector circuit is configured to: change the driving force of the normal pulse so as to reduce the driving force of the normal pulse when the driving interval of the normal pulse determined by the frequency selection circuit is relatively short; and change the driving force of the normal pulse so as to increase the driving force of the normal pulse when the driving interval of the normal pulse determined by the frequency selection circuit is relatively long.

Further, the detection pulse generator circuit includes: a first detection pulse generator circuit configured to generate a first detection pulse for detecting a current waveform (hereinafter referred to as "bell"), which is first generated on a side different from a side of the normal pulse due to a counter-electromotive force generated by the driving with the normal pulse; and a second detection pulse generator circuit configured to generate a second detection pulse for detecting a current waveform (hereinafter referred to as "well"), which is generated on the same side as the side of the normal pulse after the bell due to the counter-electromotive force generated by the driving with the normal pulse; and the rotation detector circuit is configured to instruct the frequency selection circuit based on at least any one of a first detection signal generated from the first detection pulse or a second detection signal generated from the second detection pulse.

Further, the detection pulse generator circuit further includes a third detection pulse generator circuit configured to generate a third detection pulse for detecting a current waveform (hereinafter referred to as "dummy well"), which is generated on the same side as the side of the normal pulse immediately after the normal pulse due to the counter-electromotive force generated by the driving with the normal pulse; and the rotation detector circuit is configured to instruct the frequency selection circuit based on at least anyone of the first detection signal, the second detection signal, or a third detection signal generated from the third detection pulse.

Further, the electronic watch further includes a factor detection circuit configured to specify, through factor detection, at least any one of a frequency determined by the frequency selection circuit or a driving force of the normal pulse output by the normal pulse generator circuit.

Further, the factor detection circuit includes a power supply voltage detector circuit.

Further, the electronic watch further includes a correction pulse generator circuit configured to generate a correction pulse, and to output the correction pulse to the pulse selection circuit, in which the rotation detector circuit is configured to: instruct the pulse selection circuit to output the correction pulse when the step motor is determined to have failed to rotate; and instruct the frequency selection circuit on such a frequency as to enable the correction pulse to be output.

Further, the rotation detector circuit is configured to detect a timing at which the first detection signal stops being detected after the first detection signal generated from the first detection pulse has been detected, and to notify the second detection pulse generator circuit of the timing; and the second detection pulse generator circuit is configured to generate the second detection pulse after the timing.

An electronic watch according to another embodiment of the present invention includes: a step motor; a normal pulse generator circuit configured to output a normal pulse for driving the step motor; a detection pulse generator circuit configured to output, after the step motor has been driven with the normal pulse, a detection pulse for detecting whether or not the step motor has been rotated; a pulse selection circuit configured to selectively output the normal pulse and the detection pulse; a driver circuit configured to load a pulse output from the pulse selection circuit on the step motor; and a rotation detector circuit configured to input a detection signal generated from the detection pulse, and to determine whether or not the step motor has been rotated, in which: the detection pulse generator circuit includes: a first detection pulse generator circuit configured to generate a first detection pulse for detecting a current waveform, which is generated first on a side different from a side of the normal pulse due to a counter-electromotive force generated by the driving with the normal pulse; and a second detection pulse generator circuit configured to generate a second detection pulse for detecting a current waveform, which is generated on the same side as the side of the normal pulse after the bell due to the counter-electromotive force generated due to the driving with the normal pulse; the rotation detector circuit is configured to detect a timing at which the first detection signal stops being detected after the first detection signal generated from the first detection pulse has been detected, and to notify the second detection pulse generator circuit of the timing; and the second detection pulse generator circuit is configured to generate the second detection pulse after the timing.

Advantageous Effects of Invention

As described above, according to the present invention, it is possible to provide an electronic watch configured to detect a counter-electromotive force generated from a step motor with the counter-electromotive force being divided into a plurality of detection segments, and select a driving interval and a driving force of a driving pulse based on a detection result in each of the detection segments, to thereby achieve a highest-speed fast-forward operation of the step motor based on various environments under which the watch is placed.

BRIEF DESCRIPTION OF DRAWINGS

FIG. 8-1 is a timing chart for illustrating the rotation detection operation for the electronic watch according to the modification example of the first embodiment of the present invention.

FIG. 8-2 is a timing chart for illustrating the rotation detection operation for the electronic watch according to the modification example of the first embodiment of the present invention.

FIG. 19-1 is a timing chart for illustrating the rotation detection operation for the electronic watch according to the fourth embodiment of the present invention.

FIG. 19-2 is a timing chart for illustrating the rotation detection operation for the electronic watch according to the fourth embodiment of the present invention.

DESCRIPTION OF EMBODIMENTS

Now, embodiments of the present invention are described in detail with reference to the accompanying drawings.

Features of Respective Embodiments

A first embodiment of the present invention has a feature that the first embodiment is an example of a basic configuration of the present invention, and a bell and a well of a counter-electromotive force generated from a step motor are detected by being divided into a plurality of detection segments, to thereby determine a rotation speed of a rotor. A second embodiment of the present invention has a feature that the bell of the counter-electromotive force generated from the step motor is detected by being divided into two detection segments, to thereby allow a rotation state of the rotor to be grasped quickly and widely. A third embodiment of the present invention has a feature that a dummy well, the bell, and the well of the counter-electromotive force generated from the step motor are detected with high precision by being divided into three detection segments. A fourth embodiment of the present invention has a feature that the rotation speed of the rotor is quickly determined based on a detection end position of the bell of the counter-electromotive force generated from the step motor.

First Embodiment

Figure 1:
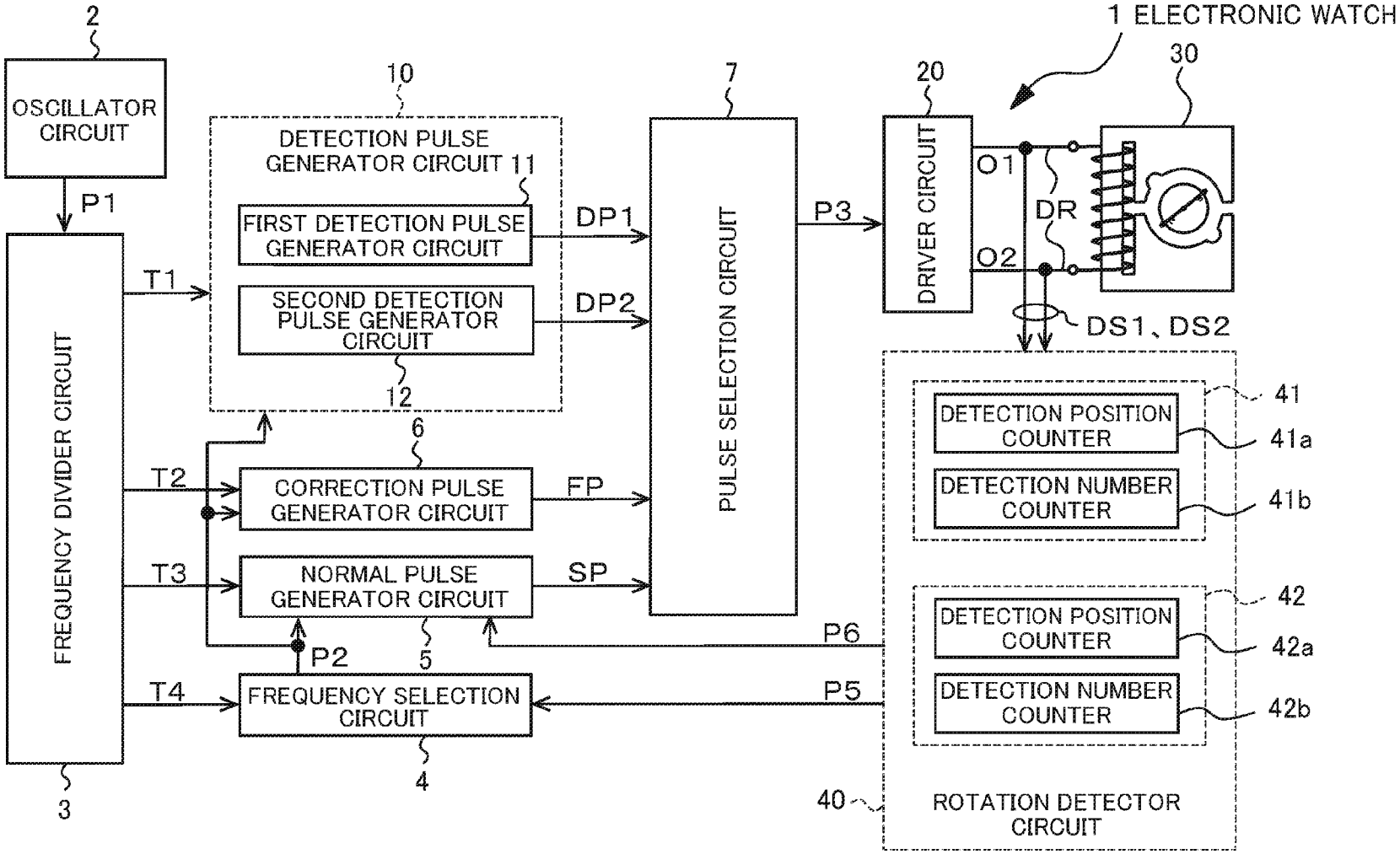
FIG. 1 is a block diagram for illustrating a schematic configuration of an electronic watch according to a first embodiment of the present invention.

[Description of Configuration of Electronic Watch According to First Embodiment: FIG. 1]

A schematic configuration of an electronic watch according to the first embodiment is described with reference to FIG. 1. The electronic watch according to the first embodiment has a feature that the bell and the well of the counter-electromotive force generated from the step motor are detected with high precision by being divided into a plurality of detection segments.

In FIG. 1, reference numeral 1 represents an electronic watch according to the first embodiment. An electronic watch 1 includes an oscillator circuit 2 configured to output a predetermined reference signal P1 based on a quartz resonator (not shown), a frequency divider circuit 3 configured to input the reference signal P1 and to output respective timing signals T1 to T4 to respective circuits, a frequency selection circuit 4 configured to output a driving interval control signal P2, a normal pulse generator circuit 5 configured to output a normal pulse SP, a correction pulse generator circuit 6 configured to output a correction pulse FP, a detection pulse generator circuit 10 configured to output a plurality of detection pulses DP1 and DP2, a pulse selection circuit 7 configured to input the normal pulse SP, the detection pulses DP1 and DP2, and the like and to output a selection pulse P3, a driver circuit 20 configured to input the selection pulse P3 and to output a drive pulse DR of a low impedance output, a step motor 30 configured to input the drive pulse DR and to move watch hands (not shown), and a rotation detector circuit 40 configured to input detection signals DS1 and DS2 from the step motor 30 and to conduct rotation detection of the rotor.

The electronic watch 1 is an analog display watch for displaying time with hands, and includes a battery serving as a power source, operation members, a wheel train, and hands. However, those components do not directly relate to the present invention, and hence descriptions thereof are omitted here.

The detection pulse generator circuit 10 includes a first detection pulse generator circuit 11 and a second detection pulse generator circuit 12. The first detection pulse generator circuit 11 is configured to output the first detection pulse DP1 for detecting the bell that occurs on a different side (reversed polarity) from that of the normal pulse SP due to the counter-electromotive force generated when the step motor 30 is driven with the normal pulse SP. The second detection pulse generator circuit 12 is configured to output the second detection pulse DP2 for detecting the well that occurs after the bell on the same side (same polarity) as that of the normal pulse SP.

The rotation detector circuit 40 includes a first detection determination circuit 41 and a second detection determination circuit 42. The first detection determination circuit 41 includes: a first detection position counter 41*a* configured to input the first detection signal DS1 generated by the first detection pulse DP1 and to examine a detection position, and a first detection number counter 41*b* configured to input the first detection signal DS1 in the same manner and to examine the number of times of detection. The second detection determination circuit 42 includes: a second detection position counter 42*a* configured to input the second detection signal DS2 generated by the second detection pulse DP2 and to examine the detection position, and a second detection number counter 42*b* configured to input the second detection signal DS2 in the same manner and to examine the number of times of detection.

The rotation detector circuit 40 is configured to grasp occurrence positions and numbers of occurrences of the first and second detection signals DS1 and DS2 based on measurement information obtained by the above-mentioned plurality of counters, and to output, to the frequency selection circuit 4, a frequency selection signal P5 that specifies a frequency for determining a driving interval of the normal pulse SP based on the information. In this case, the frequency selection circuit 4 selects a specific frequency based on the frequency selection signal P5, and outputs the selected frequency as the driving interval control signal P2 to the normal pulse generator circuit 5, the correction pulse generator circuit 6, and the detection pulse generator circuit 10.

Meanwhile, the normal pulse generator circuit 5 is configured to input the driving interval control signal P2, and to output the normal pulse SP with the driving interval control signal P2 being used as a trigger. For example, assuming that a frequency of a cycle period of 6 mS (that is, approximately 167 Hz) is selected by the frequency selection circuit 4, the driving interval control signal P2 is supplied to the normal pulse generator circuit 5 as a signal having the cycle period of 6 mS, and the normal pulse generator circuit 5 outputs the subsequent normal pulse SP 6 mS later with the driving interval control signal P2 being used as a trigger.

Further, the rotation detector circuit 40 is configured to measure the occurrence position and numbers of occurrences of the first and second detection signals DS1 and DS2 by the above-mentioned plurality of counters, to determine, based on the measured information, the rotation state of the step motor 30 and whether or not the step motor 30 has been rotated, and to output, based on a determination result thereof, a rank signal P6 for selecting a rank of a duty cycle of the normal pulse SP to the normal pulse generator circuit 5. The normal pulse generator circuit 5 switches the duty cycle of the normal pulse SP based on the rank signal P6, to thereby be able to make a driving force of the drive pulse DR to be supplied to the step motor 30 adjustable.

The driver circuit 20 has two built-in buffer circuits (not shown), and is configured to output the normal pulse SP or the correction pulse FP as the drive pulse DR from two output terminals O1 and O2 to drive the step motor 30. Further, the driver circuit 20 operates so as to cause both the two output terminals O1 and O2 to become open (high impedance) for a period corresponding to a short pulse width thereof in response to the first and second detection pulses DP1 and DP2.

With this configuration, both ends of a coil (described later) of the step motor 30 are brought into an open state for a short period of time by the first and second detection pulses DP1 and DP2. Therefore, there appears a counter-electromotive force generated in the coil during the open period, and the pulse-like counter-electromotive force is input to the rotation detector circuit 40 as the first and second detection signals DS1 and DS2. That is, the first and second detection signals DS1 and DS2 are pulse-like signals generated at the same time by the first and second detection pulses DP1 and DP2. The first and second detection pulses DP1 and DP2 and the first and second detection signals DS1 and DS2 are described later in detail.

Figure 2:
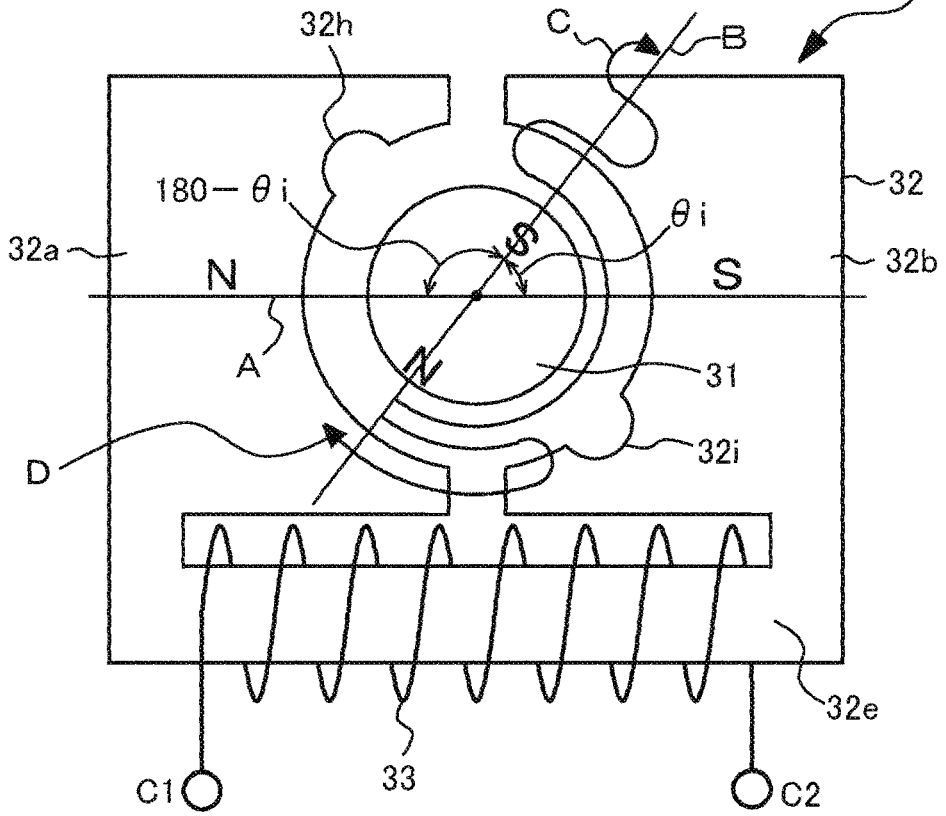
FIG. 2 are explanatory diagrams for illustrating a configuration and a basic operation of a step motor according to the first embodiment of the present invention.
Figure 2:
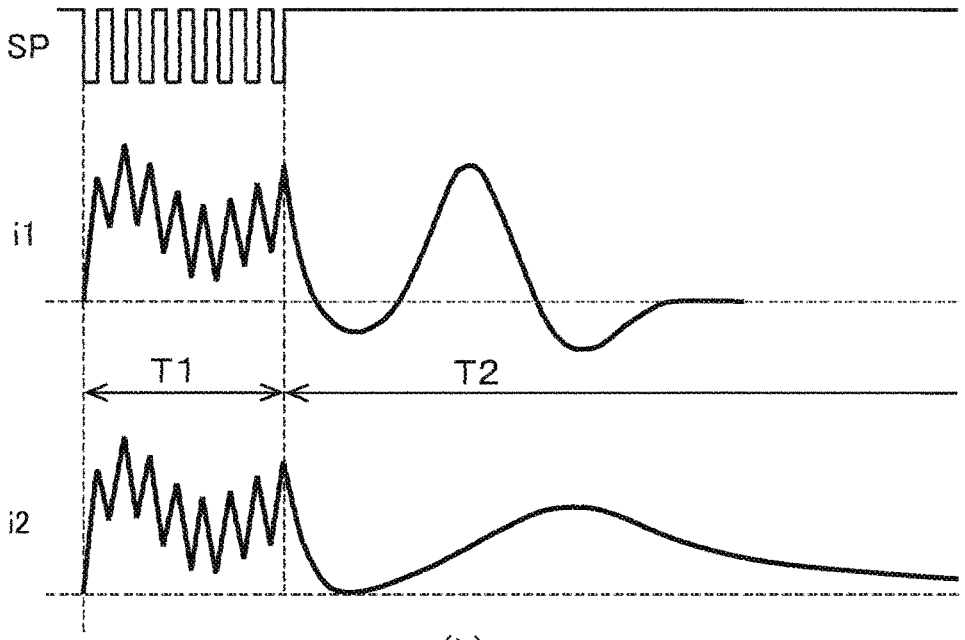

[Descriptions of Configuration and Basic Operation of Step Motor: FIGS. 2]

Next, a configuration and a basic operation of the step motor 30 are described with reference to FIG. 2. In FIG. 2(*a*), the step motor 30 includes a rotor 31, a stator 32, and a coil 33. The rotor 31 is a disc-shaped rotary body subjected to bipolar magnetization, and is polarized to have an N-pole and an S-pole in a direction along a diameter. The stator 32 is formed of a soft magnetic material, and semicircular portions 32*a* and 32*b* surrounding the rotor 31 are separated from each other by a slit. A single-phase coil 33 is wound around abase portion 32*e* at which the semicircular portions 32*a* and 32*b* are coupled to each other. "Single phase" means that the number of coils is one and the number of input terminals C1 and C2 for inputting the drive pulse DP is two.

Further, concave notches 32*h* and 32*i* are formed in predetermined positions opposed to each other on an inner peripheral surface of the semicircular portions 32*a* and 32*b* of the stator 32. The notches 32*h* and 32*i* cause a static stable point (position of a magnetic pole at a time of stop: indicated by an oblique line B) of the rotor 31 to deviate from an electromagnetic stable point (indicated by a straight line A) of the stator 32. An angular difference due to the deviation is referred to as "initial phase angle θi", and a tendency to easily rotate in a predetermined direction is imparted to the rotor 31 based on the initial phase angle θi.

Next, the basic operation of the step motor 30 is described with reference to FIG. 2(*a*) and FIG. 2(*b*). In FIG. 2(*b*), the horizontal axis indicates time. The normal pulse SP is formed of a group of a plurality of consecutive pulses as illustrated in FIG. 2(*b*), and the group of pulses has an adjustable pulse width (that is, duty cycle). The normal pulse SP is alternately supplied to the input terminals C1 and C2 of the step motor 30 as the drive pulse DR, to thereby alternately reverse magnetization of the stator 32 to rotate the rotor 31. Then, the rotation speed of the rotor 31 can be increased and decreased by making a repetition interval of the normal pulse SP adjustable, and the driving force (rotary force) of the step motor 30 can be adjusted by making the duty cycle of the normal pulse SP adjustable.

Now, in FIG. 2(*a*), when the normal pulse SP is supplied to the coil 33 of the step motor 30, the stator 32 is magnetized, and the rotor 31 is rotated by 180 degrees (rotated counterclockwise in FIG. 2(*a*) from a static stable point B, but the rotor 31 does not immediately stop in that position. In actuality, the rotor 31 overruns the position at 180 degrees, oscillates with a gradually decreasing amplitude, and comes to a stop (locus is indicated by a curved arrow C). At this time, a damped oscillation of the rotor 31 becomes a magnetic flux change with respect to the coil 33, and a counter-electromotive force due to electromagnetic induction is generated to cause an induced current to flow through the coil 33.

A current waveform i1 of FIG. 2(*b*) is an example of the induced current caused to flow through the coil 33 when the rotor 31 is normally rotated by 180 degrees by the normal pulse SP. In this case, the current waveform i1 within a driven period T1 during which the normal pulse SP is being supplied exhibits a current waveform in which driving currents due to a group of a plurality of pulses and the induced current overlap each other, and the induced current due to the damped oscillation of the rotor 31 is generated during a damped period T2 after the end of the normal pulse SP.

Further, a curved arrow D of FIG. 2(*a*) indicates a locus exhibited in a case where, even when the normal pulse SP is supplied, the rotor 31 fails to rotate and returns to its original position because the step motor 30 is affected by an external magnetic field or some other factor. A current waveform i2 of FIG. 2(*b*) is an example of the induced current caused to flow through the coil 33 when the rotor 31 fails to rotate normally.

In this case, in the current waveform i2 exhibited during the damped period T2 when the rotor 31 fails to rotate, the induced current that has a smaller amplitude than the above-mentioned current waveform i1 and has a cycle period different therefrom is generated because the rotor 31 is not rotated.

The present invention is to provide an electronic watch that aims to detect in detail the counter-electromotive force within the damped period T2 after the end of the normal pulse SP illustrated in FIG. 2(*b*) with the counter-electromotive force being divided into a plurality of detection segments, to grasp the rotation state of the rotor 31 with high accuracy, and to drive the step motor 30 at the highest speed as much as possible based on various environments under which the watch is placed. The step motor 30 is used in all of from the first embodiment to the fifth embodiment that are described later.

Figure 3:
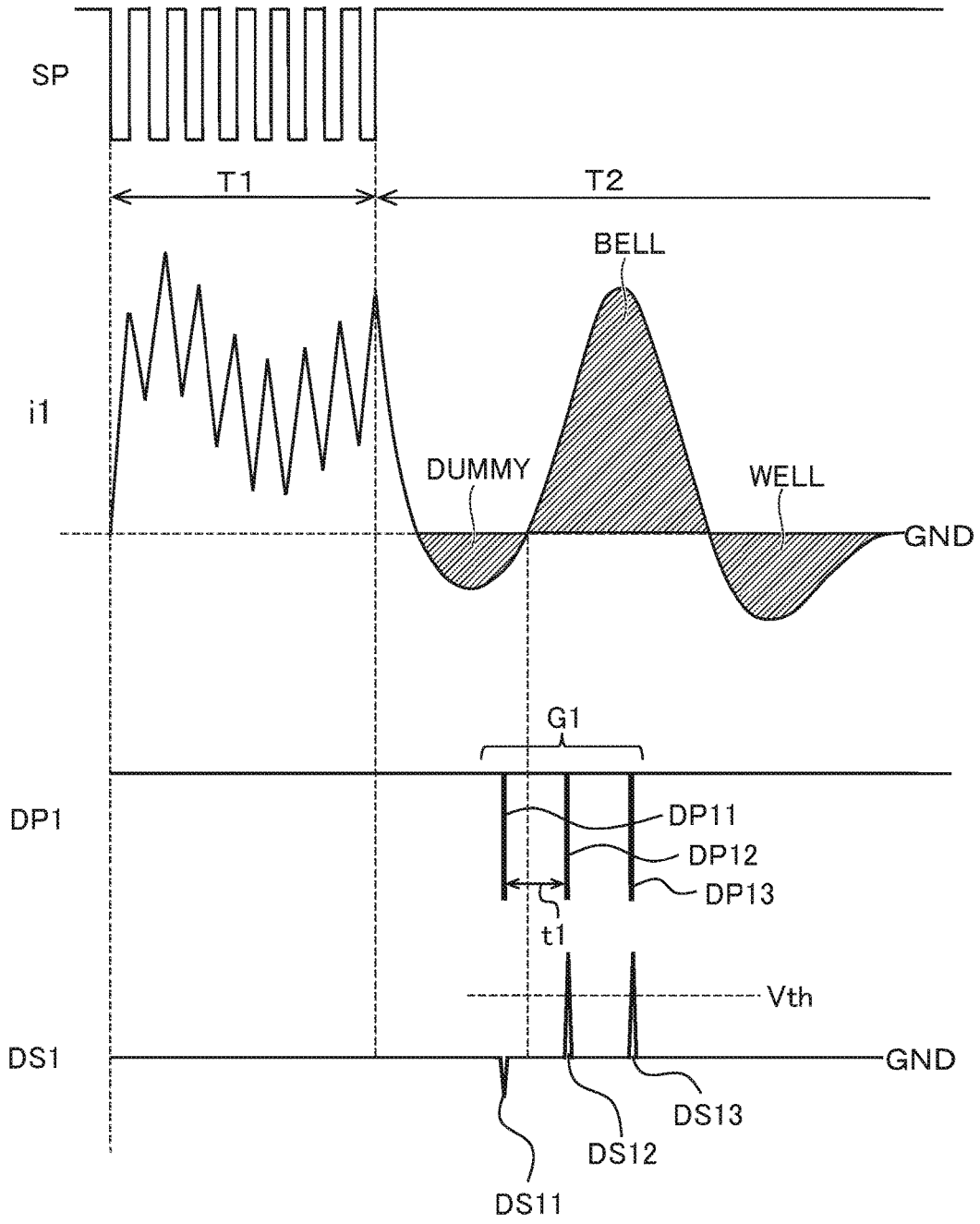
FIG. 3 is a timing chart for illustrating a current waveform due to a counter-electromotive force generated from the step motor and a basic operation of rotation detection, according to the first embodiment of the present invention.

[Description of Basic Operation of Rotation Detection of Rotor: FIG. 3]

Next, with reference to the timing chart of FIG. 3, a basic operation of how the rotation state of the rotor 31 is detected according to the present invention is described by taking as an example the above-mentioned current waveform i1 exhibited when the rotation is conducted normally as illustrated in FIG. 2(*b*). In FIG. 3, when the normal pulse SP is supplied to the step motor 30, the rotor 31 is rotated by 180 degrees as indicated by the arrow C, and is then subjected to the damped oscillation as illustrated in FIG. 2(*a*). A detailed description is made of the current waveform i1 exhibited during the damped period T2 after the end of the normal pulse SP. After the end of the driven period T1, the induced current is caused to flow on a side (positive side in terms of GND) opposite to that of the normal pulse SP due to the damped oscillation of the rotor 31, and a bell-like shape of the above-mentioned current is referred to as "bell".

After the bell, the induced current is caused to flow on the same side (negative side in terms of GND) as that of the normal pulse SP due to the damped oscillation of the rotor 31, and a bell-like shape of the above-mentioned current is referred to as "well". According to the present invention, basically, positions and periods of the bell and the well are sampled by a detection pulse formed of a plurality of detection segments, and are detected in detail, to thereby cause the rotation state of the rotor 31 to be grasped with high accuracy.

As illustrated in FIG. 3, immediately after the end of the driven period T1 and immediately before the bell, the induced current occurs on the same side (negative side in terms of GND) as that of the normal pulse SP, and a bell-like shape of the above-mentioned current is referred to as "dummy well" (hereinafter abbreviated as "dummy"). The dummy appears when the rotor 31 has not finished being rotated by 180-θi degrees as illustrated in FIG. 2(*a*) (when the rotation of the rotor is slow) even after the normal pulse SP has ended.

Although not shown in FIG. 3, there may be a case where no dummy occurs, which is a case where the rotor 31 has been rotated by 180-θi degrees while the normal pulse SP is being output (when the rotation of the rotor is fast). In this manner, the speed of the rotation of the rotor 31 can be grasped based on the presence or absence of an occurrence of the dummy and the position and period of the occurrence. The present invention also has a feature that the dummy is detected, to thereby quickly detect the rotation state of the rotor 31 with high accuracy.

Now, the rotation detection through use of the first detection pulse DP1 for detecting the bell is described as an example. The first detection pulse DP1 of FIG. 3 indicates that three pulses (DP11 to DP13) have been output within one detection segment. A segment in which the first detection pulse DP1 is output is referred to as "first detection segment G1".

In this case, as described above, the coil 33 becomes open for a short period of time by the first detection pulse DP1, and the first detection signal DS1 is generated from the input terminals C1 and C2, but the first pulse DP11 is output in the region of the dummy of the current waveform i1. Therefore, DS11 generated by DP11 is on the negative side in terms of GND, and the bell is not detected.

The second and third pulses DP12 and DP13 are output in the region of the bell of the current waveform i1, and hence DS12 and DS13 generated by DP12 and DP13 are on the positive side in terms of GND to exceed Vth. Therefore, it is determined that the bell has been detected. That is, in the example illustrated in FIG. 3, the bell has been detected by the second and third signals of the first detection signal DS1 within the first detection segment G1.

In this manner, the first detection segment G1 for detecting the bell is set to a period in which the bell is likely to occur (that is, period that allows the first detection signal DS1 to be detected). The detection of a current waveform i based on the counter-electromotive force generated from the step motor 30 is determined in actuality based on whether or not a voltage waveform exceeds Vth set in advance as illustrated in FIG. 3 after the current waveform i is converted into the voltage waveform inside the rotation detector circuit 40.

As described later in detail, although not shown in this case, a second detection segment G2 is set to a period in which the well is likely to occur, and a predetermined second detection pulse DP2 is output, to thereby detect the well. Further, a third detection segment G3 is set to a period in which the dummy is likely to occur, and a predetermined third detection pulse DP3 is output, to thereby also detect the dummy.

In this manner, according to the present invention, the first detection pulse DP1 and the second detection pulse DP2 are output by being divided into predetermined detection segments, and the driving interval (frequency) and the duty cycle of the normal pulse SP are selected based on a detection result within the detection segment, to thereby achieve a fast forward operation of the step motor with as fast a speed as possible.

Each of the detection segments may be divided into smaller segments. For example, although not shown, the first detection segment G1 for detecting the bell may be divided into a first half G1*a* and a second half G1*b*, and the driving interval and the like of the normal pulse SP may be selected based on detection results within the divided detection segments. With this configuration, it is possible to achieve fine driving control based on the rotation state of the rotor 31.

Further, a repetition cycle period t1 of the detection pulse DP within each of the detection segments, which is illustrated in FIG. 3, may be selected arbitrarily based on the detected current waveform. The current wave form can be subjected to finer sampling with the cycle period t1 being set shorter, while the current waveform is subjected to rougher sampling with the cycle period t1 being set longer. Further, there are no limitations imposed on the pulse width of the detection pulse DP, but the pulse width required for the generation of the detection signal DS is set.

Figure 4:
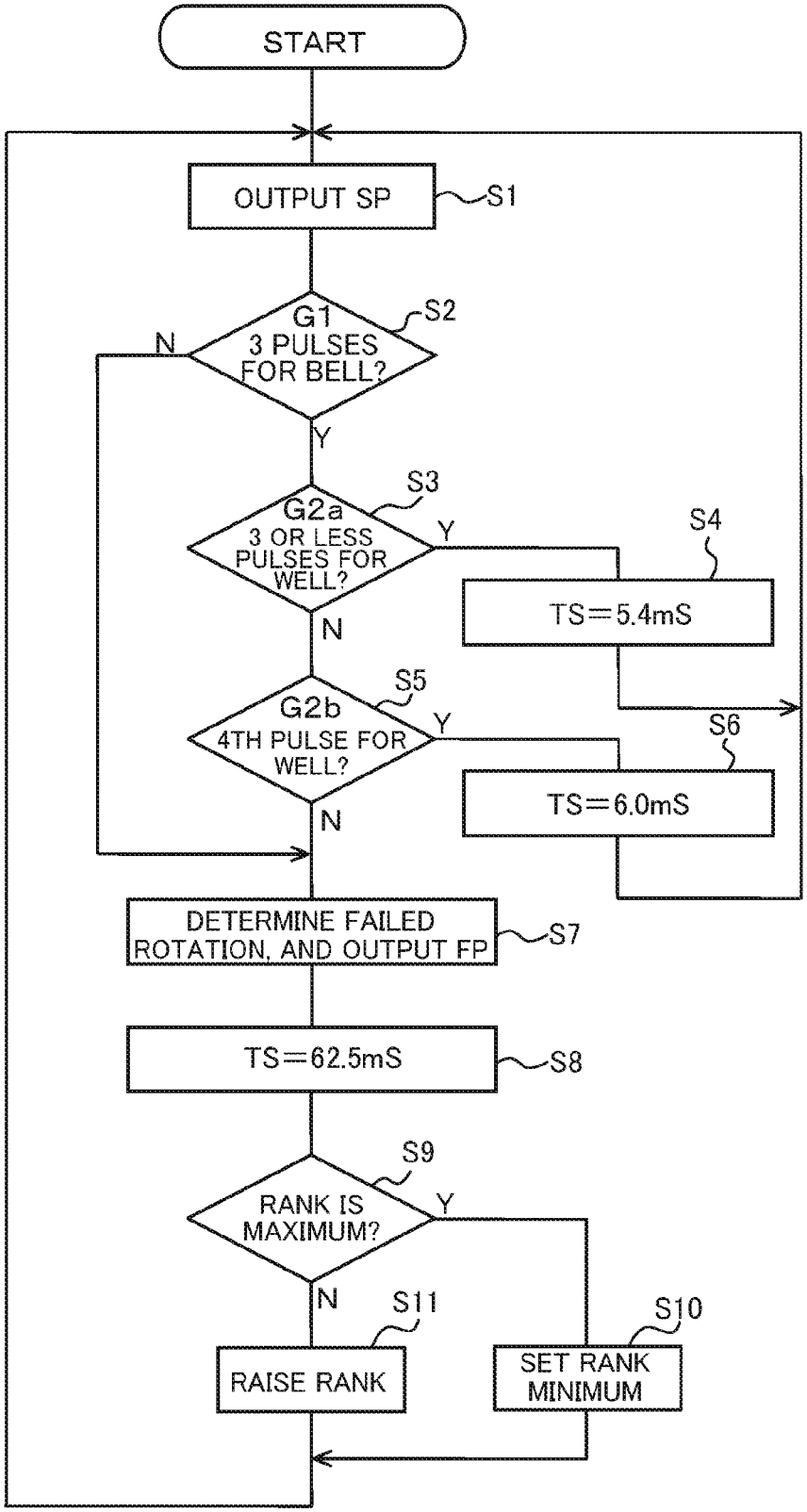
FIG. 4 is a flowchart for illustrating a rotation detection operation for the electronic watch according to the first embodiment of the present invention.
Figure 5:
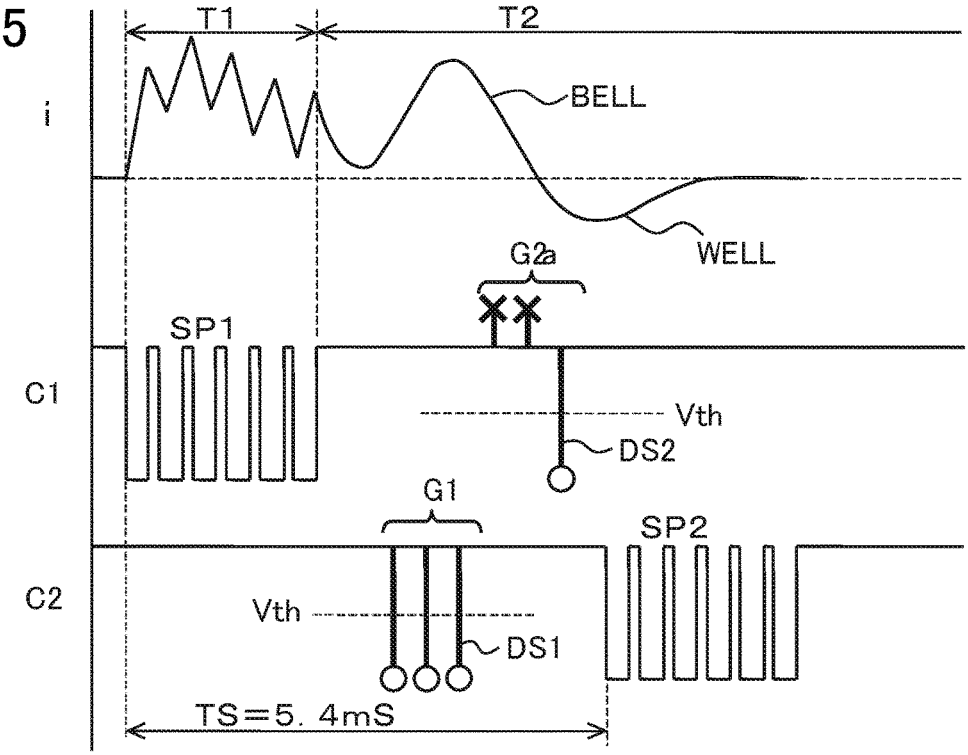
FIG. 5 are timing charts for illustrating the rotation detection operation for the electronic watch according to the first embodiment of the present invention.
Figure 5:
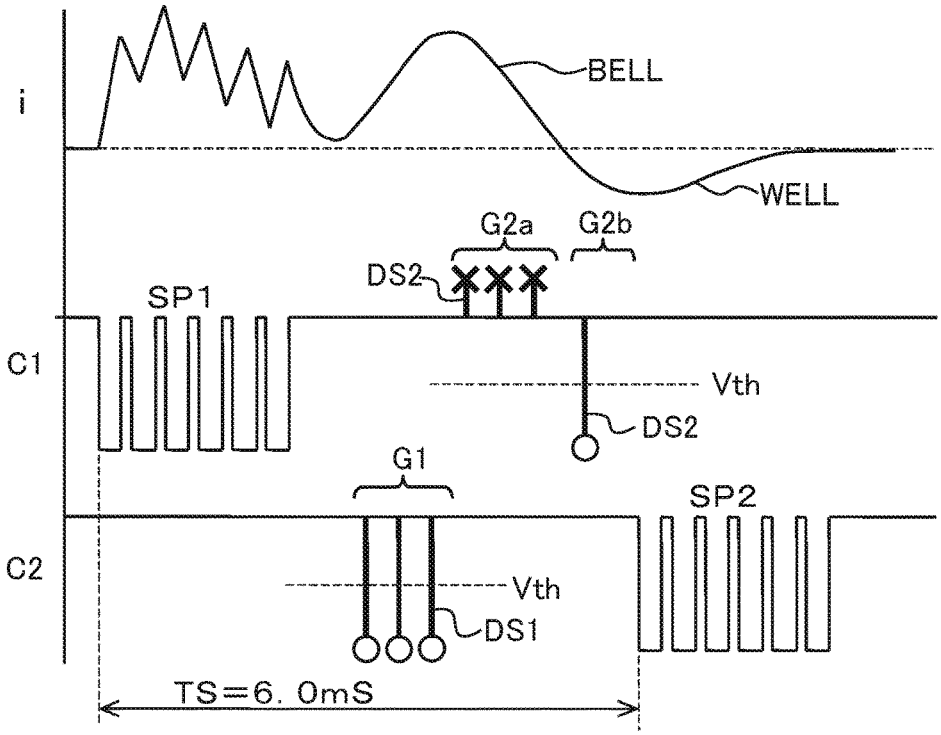
Figure 6:
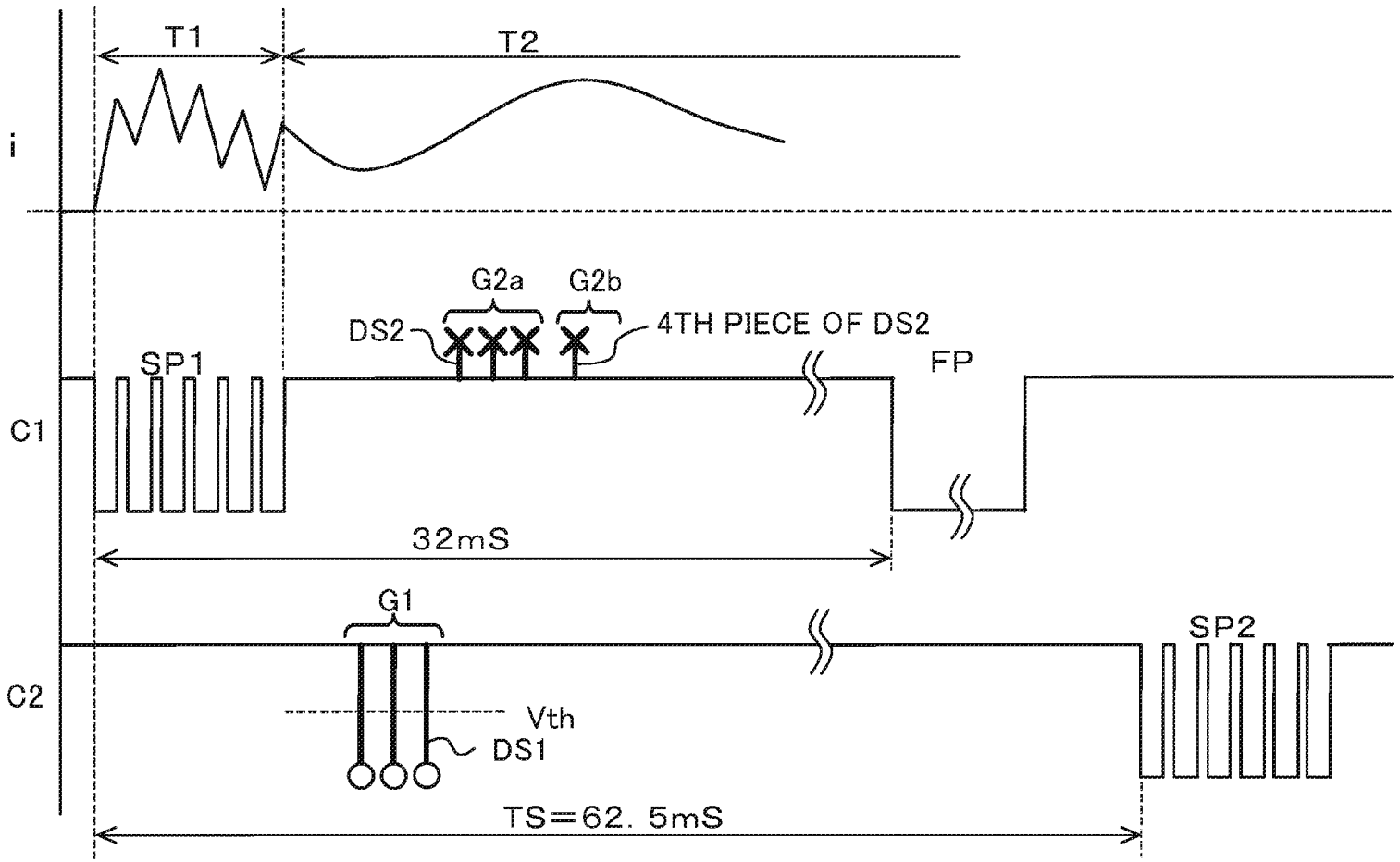
FIG. 6 is a timing chart for illustrating an operation conducted when it is determined that a rotation failure has occurred in the rotation detection operation for the electronic watch, according to the first embodiment of the present invention.

[Description of Rotation Detection in Fast-Forward Operation According to First Embodiment: FIG. 4 to FIG. 6]

Next, the rotation detection conducted in the fast-forward operation for the step motor according to the first embodiment is described with reference to the flowchart of FIG. 4 and timing charts of FIG. 5 and FIG. 6. In this case, the timing charts of FIG. 5 and FIG. 6 are schematic illustrations of examples of the current waveform i due to the counter-electromotive force generated from the step motor 30, the normal pulse SP supplied to the input terminals C1 and C2 of the step motor 30, and the first and second detection signals DS1 and DS2 generated in the input terminals C1 and C2.

FIG. 5(*a*) relates to a case where a driving interval TS of the normal pulse SP is set to approximately 5.4 mS, FIG. 5(*b*) relates to a case where the driving interval TS of the normal pulse SP is set to approximately 6.0 mS, and FIG. 6 is an example of a case where the rotor 31 has been determined to have a rotation failure. With the electronic watch 1 having the configuration described with reference to FIG. 1, the description is made based on the premise that the step motor 30 is in a fast-forward operation.

In FIG. 4, a normal pulse SP is generated from the normal pulse generator circuit 5, and passes through the pulse selection circuit 7, and a normal pulse SP1 is output as the drive pulse DR from the output terminal O1 of the driver circuit 20, and is supplied to the input terminal C1 of the step motor 30 (Step S1). In this case, as illustrated in FIG. 5 and FIG. 6, the normal pulse SP1 is formed of a group of a plurality of pulses based on a predetermined duty cycle within the driven period T1.

Subsequently in FIG. 4, the first detection pulse generator circuit 11 outputs three first detection pulses DP1 for detecting the bell, which define the first detection segment G1, and the first detection determination circuit 41 determines whether or not the bell has been detected with three pulses based on the first detection position counter 41*a* and the first detection number counter 41*b* (Step S2).

In this case, when the determination is positive (the bell has been detected with three pulses), the procedure advances to the subsequent Step S3, while when the determination is negative (there is no such detection), a rotation is determined to have failed, and the procedure advances to Step S7. In this case, FIG. 5 and FIG. 6 indicate that the bell has been detected with Vth being exceeded by, for example, three first detection signals DS1 within the first detection segment G1 after the end of the driven period T1 and after the start of the damped period T2 (three pieces of DS1 are indicated by "○").

Subsequently in FIG. 4, the second detection pulse generator circuit 12 outputs three second detection pulses DP2 for detecting the well, which define a first half G2*a* of the second detection segment G2 (hereinafter abbreviated as "second segment first half G2*a*"), and the second detection determination circuit 42 determines whether or not the well has been detected with three or less pulses based on the second detection position counter 42*a* and the second detection number counter 42*b* (Step S3).

In this case, when the determination is positive (the well has been detected with three or less pulses), the procedure advances to Step S4, and when the determination is negative (the well has not been detected), the procedure advances to Step S5. In this case, FIG. 5(*a*) indicates that the well has been detected with Vth being exceeded by the third piece of the second detection signal DS2 generated based on the second detection pulse DP2 in the second segment first half G2*a* (the first and second pieces of DS2 are indicated by "x", and the third piece thereof is indicated by "○").

Subsequently in FIG. 4, when the determination is positive in Step S3, the rotation detector circuit 40 uses the frequency selection signal P5 to instruct the frequency selection circuit 4 to select such a frequency that the driving interval TS of the normal pulse SP becomes approximately 5.4 mS being the fastest speed (Step S4). As a result, the frequency selection circuit 4 supplies the driving interval control signal P2 having the driving interval TS of approximately 5.4 mS to the normal pulse generator circuit 5, and hence, as illustrated in FIG. 5(*a*), the normal pulse SP2 subsequent to the normal pulse SP1 supplied to the input terminal C1 is supplied to the input terminal C2 after the lapse of (driving interval TS)=(approximately 5.4 mS).

Then, the procedure returns from Step S4 to Step S1. Therefore, when the determination is always positive in Step S2 and Step S3, the processing of from Step S1 to Step S4 is continued, and the normal pulse SP keeps being output at the highest speed of (driving interval TS)=(approximately 5.4 mS), which allows the step motor 30 to continue the rotation at the highest speed.

In this case, the reason why the normal pulse SP is output at the highest speed when the determination is positive in Step S3 is that the rotation of the rotor 31 has been determined to be smooth with high momentum and that the step motor 30 has been determined to be ready to undergo rotation drive at the highest speed based on the fact that the bell has been detected with three pulses within the first detection segment G1 and then the well has been detected with three or less pulses within the second segment first half G2*a*.

When the determination is negative in Step S3, the second detection pulse generator circuit 12 outputs the fourth piece of the second detection pulse DP2 for detecting the well, which defines a second half G2*b* of the second detection segment G2 (hereinafter abbreviated to "second segment second half G2*b*"), and the second detection determination circuit 42 determines whether or not the well has been detected with the fourth pulse based on the second detection position counter 42*a* and the second detection number counter 42*b* (Step S5). In this case, when the determination is positive (the well has been detected with the fourth pulse), the procedure advances to Step S6. When the determination is negative (the well has not been detected), the rotation is determined to have failed, and the procedure advances to Step S7.

In this case, FIG. 5(*b*) indicates that none of three second detection signals DS2 has been detected within the second segment first half G2*a*, and that the well has been detected with Vth being exceeded by the fourth piece of the second detection signal DS2 within the subsequent second segment second half G2*b* (the first to third pieces of DS2 are indicated by "x", and the fourth piece of DS2 is indicated by "○").

Subsequently in FIG. 4, when the determination is positive in Step S5, the rotation detector circuit 40 uses the frequency selection signal P5 to instruct the frequency selection circuit 4 to select such a frequency that the driving interval TS of the normal pulse SP becomes approximately 6.0 mS, which is slower than the fastest speed (Step S6). As a result, the frequency selection circuit 4 supplies the driving interval control signal P2 having the driving interval TS of approximately 6.0 mS to the normal pulse generator circuit 5, and hence, as illustrated in FIG. 5(*b*), the normal pulse SP2 subsequent to the normal pulse SP1 supplied to the input terminal C1 is supplied to the input terminal C2 after the lapse of (driving interval TS)=(approximately 6.0 mS).

Then, the procedure returns from Step S6 to Step S1. Therefore, when the determination is always positive in Step S2, negative in Step S3, and positive in Step S5, the processing of from Step S1 to Step S6 is continued, and the normal pulse SP keeps being output at (driving interval TS)=(approximately 6.0 mS), which allows the step motor 30 to continue the rotation at approximately 6.0 mS, which is around 10% slower than the highest speed.

In this case, the reason why the normal pulse SP is output at a speed of approximately 6.0 mS, which is slower than the highest speed, when the determination is positive in Step S5 is that the rotation of the rotor 31 can be determined to be somewhat slow due to some factor based on the fact that the well has not been detected with three or less pulses within the second segment first half G2*a* and has been detected with the fourth pulse within the second segment second half G2*b*. That is, in a case where the rotation of the rotor 31 is slow, when the subsequent normal pulse SP is supplied at the highest speed, a rotation error may be caused in the rotor 31, and hence the driving interval TS of the normal pulse SP is adjusted depending on the rotation state of the rotor 31, to thereby be able to prevent the rotation error.

Subsequently in FIG. 4, when the determination is negative in Step S2 or Step S5, it is determined that the rotor 31 has failed to rotate. Therefore, the detection pulse generator circuit 10 stops generating subsequent detection pulses, and the rotation detector circuit 40 instructs the frequency selection circuit 4 on a frequency (for example, a cycle period of 32 mS) in order to output a correction pulse FP. With this configuration, the frequency selection circuit 4 outputs the selected frequency to the correction pulse generator circuit 6 as the driving interval control signal P2, and the correction pulse generator circuit 6 outputs the correction pulse FP (Step S7).

In this case, FIG. 6 is an illustration of a timing operation conducted when the determination is negative (that is, the rotation has failed) in Step S5. FIG. 6 indicates that, after the normal pulse SP1 is supplied to the input terminal C1 (after T1) and after the damped period T2 starts, the bell has been detected by three first detection signals DS1 within the first detection segment G1 (three pieces of DS1 are indicated by "○"), then the well has not been detected by three second detection signals DS2 within the second segment first half G2*a*, and the well has not been detected even by the fourth piece of the second detection signal DS2 within the second segment second half G2*b* (the first to third pieces and the fourth piece of DS2 are indicated by "x").

As a result, the well has not been detected within the second segment first half G2*a* or the second segment second half G2*b*, and hence it is determined that the rotor 31 has failed to rotate. For example, after the lapse of approximately 32 mS, the correction pulse FP having a wide pulse width and a strong driving force is supplied to the same input terminal C1 to which the normal pulse SP1 has been supplied, to thereby correct the rotation error of the rotor 31.

Subsequently in FIG. 4, the rotation error of the rotor 31 has occurred, and hence, in order to decelerate the fast-forward operation of the rotor 31, the rotation detector circuit 40 uses the frequency selection signal P5 to instruct the frequency selection circuit 4 to select such a frequency that the driving interval TS of the normal pulse SP becomes approximately 62.5 mS (Step S8).

Subsequently, the rotation detector circuit 40 determines whether or not the rank of the duty cycle of the normal pulse SP is maximum (Step S9). In this case, the duty cycle of the normal pulse SP includes a plurality of ranks, and selection can be made stepwise from a rank exhibiting the smallest driving force (that is, the lowest duty cycle) to a rank exhibiting the largest driving force (that is, the highest duty cycle).

When the determination is positive (the rank is maximum) in Step S9, the rotation error has occurred even with the maximum rank, and hence the rank is set to the minimum in order to temporarily restore the minimum rank (Step S10). When the determination is negative in Step S9, the rotation error has occurred with the currently set rank, and hence in order to increase the driving force of the normal pulse SP, the rank is raised (that is, the duty cycle is increased; Step S11). That is, the rotation detector circuit 40 can instruct the normal pulse generator circuit 5 to select the duty cycle of the normal pulse SP based on a determination result as to whether or not the step motor 30 has been rotated. The number of ranks of the duty cycle is arbitrary, but, for example, 8 ranks to 16 ranks are set.

Subsequently in FIG. 4, as the subsequent step to be conducted after Step S10 or Step S11, the procedure returns to Step S1 to continue the operation for outputting the subsequent normal pulse SP. In this case, the frequency selection circuit 4 is instructed on (driving interval TS)=(approximately 62.5 mS) as described above, and hence the subsequent normal pulse SP2 is supplied to the input terminal C2 after the lapse of (driving interval TS)(approximately 62.5 mS) as illustrated in FIG. 6.

Subsequently, the operation of Step S2 and the subsequent steps is continued. For example, when it is determined in Step S3 that the well has been detected with three or less pulses, the rotor 31 is determined to have been rotated normally with high momentum, the driving interval TS is set to 5.4 mS being the fastest speed in Step S4, and the rotor 31 restarts the rotation at the highest speed.

Although not illustrated in the flowchart of FIG. 4, when the rotation of the rotor 31 is determined to have failed, and when the rank of the normal pulse SP is changed by being instructed to be selected in Step S10 or Step S11, a detection condition (for example, detection segment width or number of times of detection) within each of the detection segments may be changed for the subsequent processing to conduct adjustment so as to allow the rotation detection of the rotor 31 to be conducted more appropriately. For example, when the rank is set to the minimum in Step S10, the rotation of the rotor 31 may be caused to become slower, and hence the detection condition for the well used in Step S5 for the subsequent processing may be relaxed so as to conduct a change so that, for example, the second detection pulse DP2 is detected up to the fifth pulse within the second segment second half G2*b* and the rotor 31 is determined to have been rotated when the well is successfully detected under the above-mentioned condition.

As described above, according to the first embodiment, it is possible to provide an electronic watch configured to detect the counter-electromotive force generated from the step motor 30 with the counter-electromotive force being divided into a plurality of detection segments, and select the driving interval TS (frequency) and the driving force (duty cycle) of the normal pulse SP based on the occurrence position, that is, the detection position, the number of times of detection, and the like of a detection signal for detecting the bell and the well of the current waveform, to thereby achieve the fast-forward operation with the highest speed possible based on various environments under which the watch is placed. There are no limitations imposed on each of the driving intervals TS of the normal pulse SP, and the driving intervals TS may be selected arbitrarily based on performance of the step motor 30, specifications of the electronic watch, and the like.

Figure 7:
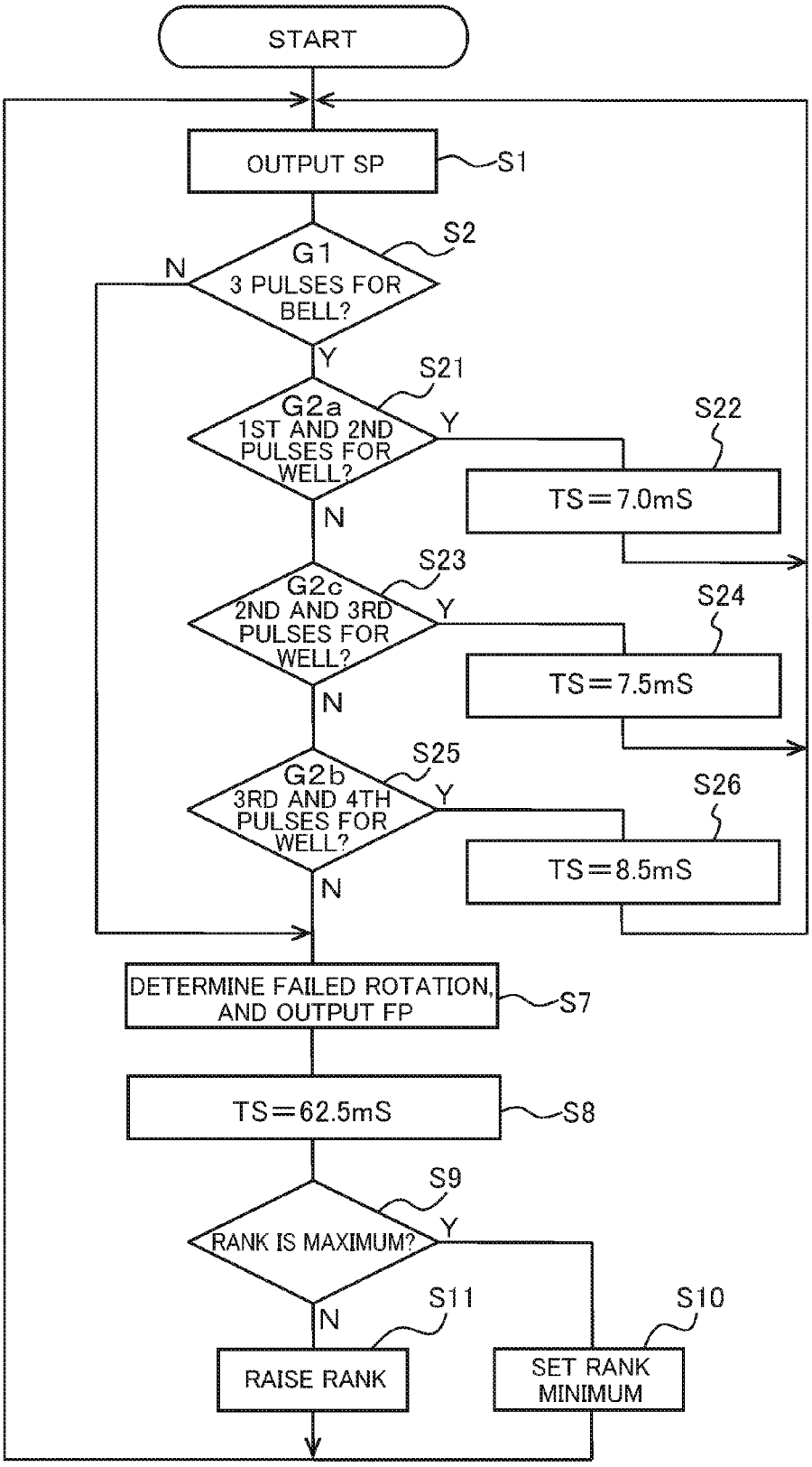
FIG. 7 is a flowchart for illustrating a rotation detection operation for the electronic watch according to a modification example of the first embodiment of the present invention.
Figure 8:
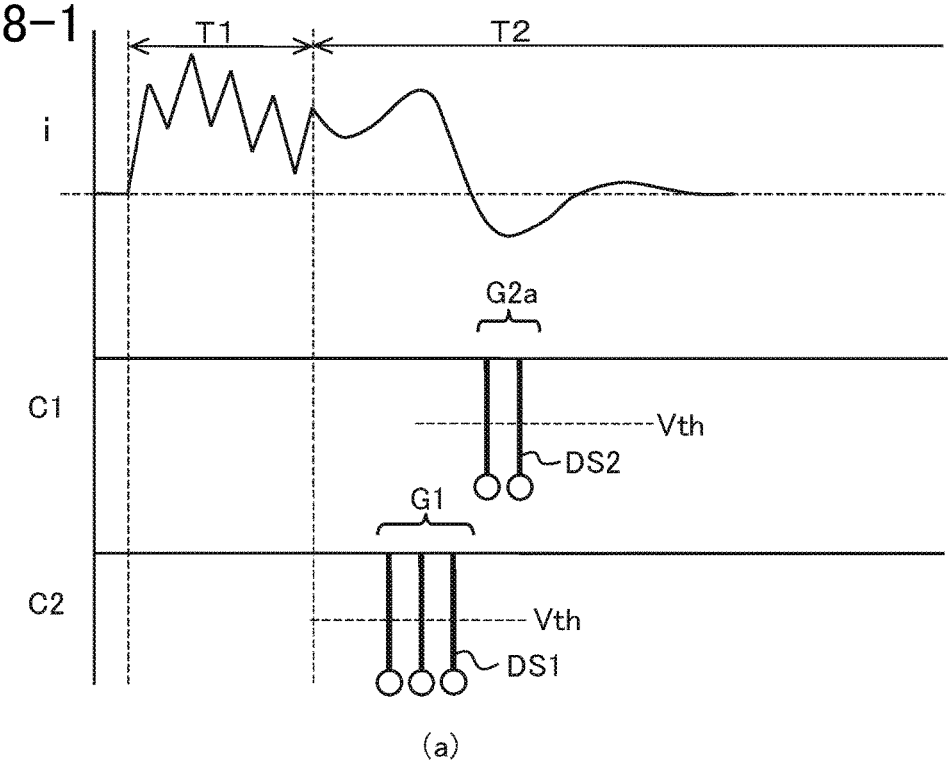
Figure 1:
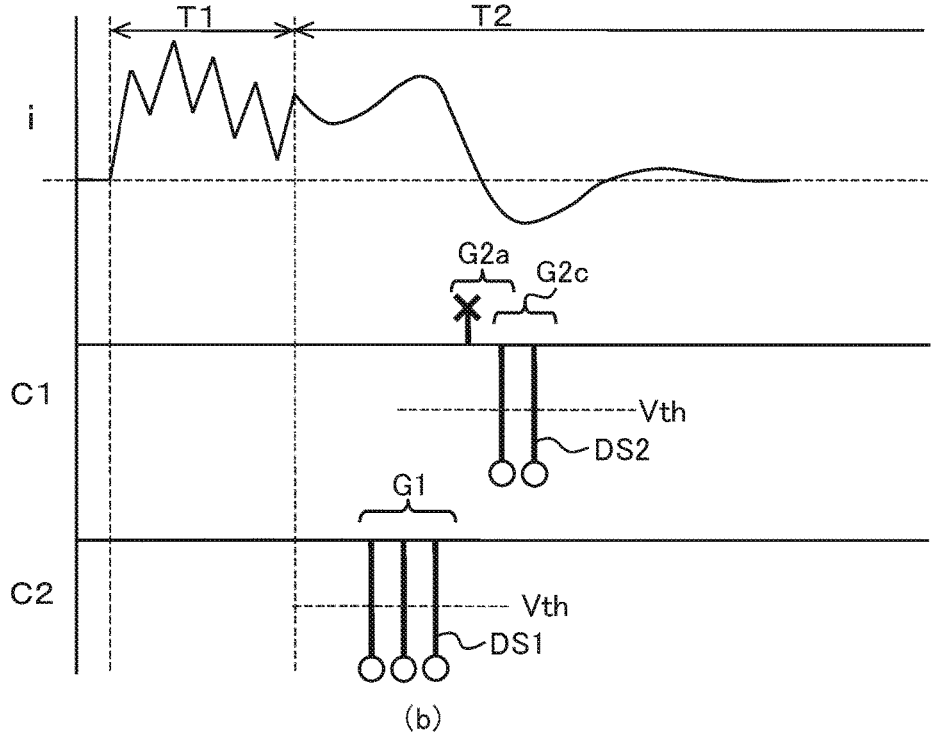
Figures 2, 8:
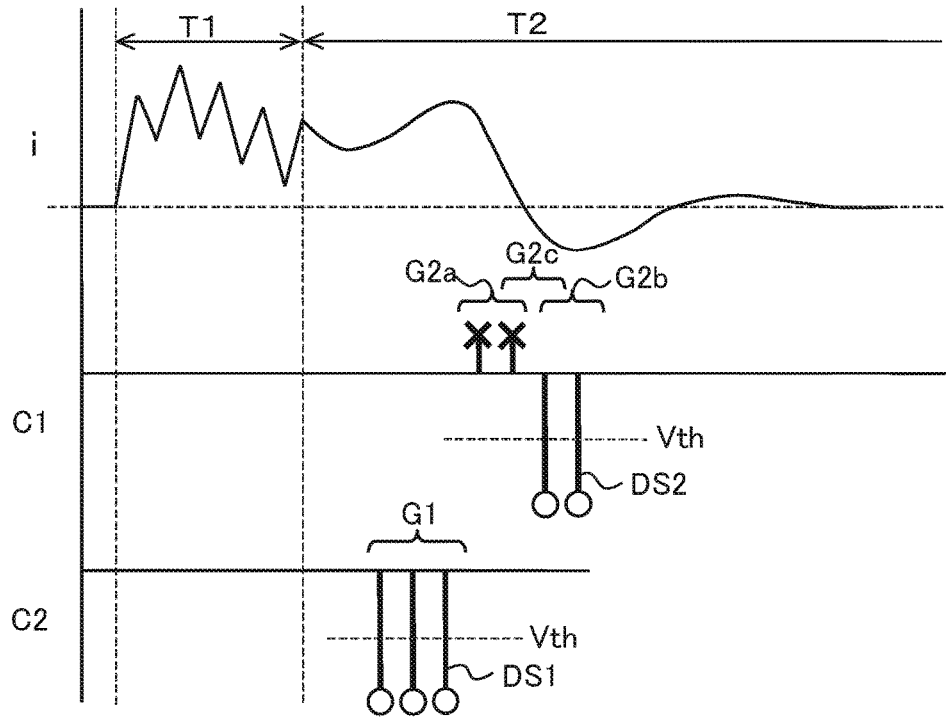

[Description of Rotation Detection Operation According to Modification Example of First Embodiment; FIG. 7 and FIGS. 8]

Next, rotation detection conducted in a fast-forward operation of a step motor according to a modification example of the first embodiment is described with reference to the flowchart of FIG. 7 and timing charts of FIG. 8. An electronic watch according to the modification example of the first embodiment has a feature that the bell and the well of the counter-electromotive force generated from the step motor are detected within a plurality of detection segments, the detection segment for detecting the well being divided into a plurality of segments with the divided detection segments being formed so as to cover another adjacent detection segment, to thereby be able to finely detect the rotation state of the rotor. For the sake of convenience, FIG. 8 are divided into FIG. 8-1 that contains FIG. 8(*a*) and FIG. 8(*b*) and FIG. 8-2 that contains FIG. 8(*c*).

Specifically, in the modification example of the first embodiment, the second detection segment G2 for detecting the well is divided into three detection segments of the second segment first half G2*a*, a second segment middle G2*c*, and the second segment second half G2*b*. The second segment first half G2*a* is formed of the first and second pieces of the second detection pulse DP2, the second segment middle G2*c* is formed of the second and third pieces of the second detection pulse DP2, and the second segment second half G2*b* is formed of the third and fourth pieces of the second detection pulse DP2. That is, the detection pulse that forms each of the detection segments covers adjacent detection segments.

In this case, the timing charts of FIG. 8 are schematic illustrations of examples of the current waveform i due to the counter-electromotive force generated from the step motor 30 and the first and second detection signals DS1 and DS2 generated in the input terminals C1 and C2 of the step motor 30. The illustration of the normal pulse SP is omitted. FIG. 8(*a*) indicates a case where the well has been successfully detected by two signals within the second segment first half G2*a*, FIG. 8(*b*) indicates a case where the well has been successfully detected by two signals within the second segment middle G2*c*, and FIG. 8(*c*) indicates a case where the well has been successfully detected by two signals within the second segment second half G2*b*.

With the electronic watch 1 having the configuration described with reference to FIG. 1, the description is made based on the premise that the step motor 30 is in a fast-forward operation. Of the respective steps, steps featuring the same operation as that of the flowchart of FIG. 4 according to the first embodiment described above are denoted by like reference symbols, and a detailed description thereof is omitted.

In the flowchart of FIG. 7, the normal pulse SP is generated from the normal pulse generator circuit 5, and is supplied to the step motor 30 to drive the step motor 30 (Step S1).

Subsequently in FIG. 7, the first detection pulse generator circuit 11 outputs three first detection pulses DP1 for detecting the bell as the first detection segment G1, and the first detection determination circuit 41 determines whether or not the bell has been detected with three pulses (Step S2). In this case, when the determination is positive (the bell has been detected with three pulses), the procedure advances to the subsequent Step S21. When the determination is negative (there is no such detection), the rotation is determined to have failed, and the procedure advances to Step S7. In this case, FIG. 8(*a*) to FIG. 8(*c*) indicate that the bell has been detected with Vth being exceeded by, for example, three first detection signals DS1 within the first detection segment G1 after the end of the driven period T1 and after the start of the damped period T2 (three pieces of DS1 are indicated by "○").

Subsequently in FIG. 7, the second detection pulse generator circuit 12 outputs two second detection pulses DP2 for detecting the well within the second segment first half G2*a*, and the second detection determination circuit 42 determines whether or not the well has been detected with two pulses (Step S21). In this case, when the determination is positive (the well has been detected with two pulses), the procedure advances to Step S22, and when the determination is negative (the well has not been detected), the procedure advances to Step S23.

In this case, FIG. 8(*a*) indicates the case where the determination is positive in Step S21, and indicates that the well has been detected with Vth being exceeded by both the first piece and the second piece of the second detection signal DS2 generated based on two pieces of the second detection pulse DP2 in the second segment first half G2*a* (the first and second pieces of DS2 are indicated by "○").

Subsequently in FIG. 7, when the determination is positive in Step S21, the well has been detected within the second segment first half G2*a*, the rotation detector circuit 40 uses the frequency selection signal P5 to instruct the frequency selection circuit 4 to select such a frequency that the driving interval TS of the normal pulse SP becomes, for example, approximately 7.0 mS (Step S22). As a result, the frequency selection circuit 4 supplies the driving interval control signal P2 having the driving interval TS of approximately 7.0 mS to the normal pulse generator circuit 5, and hence, although not shown, the subsequent normal pulse SP is output after the lapse of (driving interval TS)=(approximately 7.0 mS). This means that the driving interval TS is reduced by determining that the rotation state of the rotor 31 is fast because the well has been detected within the second segment first half G2*a*.

Then, the procedure returns to Step S1 as processing subsequent to Step S22. Therefore, when the determination is always positive in Step S2 and Step S21, the processing of from Step S1 to Step S22 is continued, and the normal pulse SP keeps being output at (driving interval TS)=(approximately 7.0 mS), which allows the step motor 30 to continue the fast-forward operation at relatively high speed.

In FIG. 7, when the determination is negative in Step S21, the second detection pulse generator circuit 12 outputs one second detection pulse DP2 for detecting the well as the second segment middle G2*c* (that is, three pulses in total as the second detection pulse DP2), and the second detection determination circuit 42 determines whether or not the well has been detected with the second and third pulse (Step S23). In this case, when the determination is positive (the well has been detected with two pulses), the procedure advances to Step S24, and when the determination is negative (the well has not been detected), the procedure advances to Step S25.

In this case, FIG. 8(*b*) indicates the case where the determination is positive in Step S23, and indicates that the well has not been detected by the first piece of the second detection signal DS2 within the second segment first half G2*a*, and that the well has been detected with Vth being exceeded by the total two pulses of the second and third pieces of the second detection signal DS2 within the second segment middle G2*c* (the first piece of DS2 is indicated by "x", and the second and third pieces thereof are indicated by "○").

Subsequently in FIG. 7, when the determination is positive in Step S23, the well has been detected within the second segment middle G2*c*, the rotation detector circuit 40 uses the frequency selection signal P5 to instruct the frequency selection circuit 4 to select such a frequency that the driving interval TS of the normal pulse SP becomes, for example, approximately 7.5 mS (Step S24). As a result, the frequency selection circuit 4 supplies the driving interval control signal P2 having the driving interval TS of approximately 7.5 mS to the normal pulse generator circuit 5, and hence, although not shown, the subsequent normal pulse SP is output after the lapse of (driving interval TS)=(approximately 7.5 mS). This means that the driving interval TS is made moderate by determining that the rotation state of the rotor 31 is a moderate speed because the well has been detected within the second segment middle G2*c*.

Then, the procedure returns to Step S1 as processing subsequent to Step S24. Therefore, when the determination is always positive in Step S23, negative in Step S21, and positive in Step S23, the processing of from Step S1 to Step S24 is continued, and the normal pulse SP keeps being output at (driving interval TS)=(approximately 7.5 mS, which allows the step motor 30 to continue the fast-forward operation at the moderate speed.

Subsequently in FIG. 7, when the determination is negative in Step S23, the second detection pulse generator circuit 12 additionally outputs one second detection pulse DP2 for detecting the well as the second segment second half G2*b* (that is, four pulses in total as the second detection pulse DP2), and the second detection determination circuit 42 determines whether or not the well has been detected with the third and fourth pulses (Step S25). In this case, when the determination is positive (the well has been detected with two pulses), the procedure advances to Step S26, and when the determination is negative (the well has not been detected), it is determined that rotation has failed and the procedure advances to Step S7.

In this case, FIG. 8(*c*) indicates the case where the determination is positive in Step S25, and indicates that the well has not been detected in the second segment first half G2*a* and the second segment middle G2*c*, and that the well has been detected with Vth being exceeded by the third and fourth pieces of the second detection signal DS2 within the second segment second half G2*b* (the first and second pieces of DS2 are indicated by "x", and the third and fourth pieces thereof are indicated by "○").

Subsequently in FIG. 7, when the determination is positive in Step S25, the rotation detector circuit 40 uses the frequency selection signal P5 to instruct the frequency selection circuit 4 to select such a frequency that the driving interval TS of the normal pulse SP becomes, for example, approximately 8.5 mS (Step S26). As a result, the frequency selection circuit 4 supplies the driving interval control signal P2 having the driving interval TS of approximately 8.5 mS to the normal pulse generator circuit 5, and hence, although not shown, the subsequent normal pulse SP is output after the lapse of (driving interval TS)=(approximately 8.5 mS). This means that the driving interval TS is increased by determining that the rotation state of the rotor 31 is slow because the well has been detected within the second segment second half G2*b*.

Then, the procedure returns to Step S1 as processing subsequent to Step S26. Therefore, when the determination is always positive in Step S22, negative in Step S21, negative in Step S23, and positive in Step S25, the processing of from Step S1 to Step S26 is continued, and the normal pulse SP keeps being output at (driving interval TS)=(approximately 8.5 mS), which allows the step motor 30 to continue the fast-forward operation at relatively low speed.

Subsequently in FIG. 7, when the determination is negative in Step S2 or Step S25, it is determined that the rotor 31 has failed to rotate. Therefore, the detection pulse generator circuit 10 stops generating the subsequent detection pulses, and the rotation detector circuit 40 activates the correction pulse generator circuit 6 to output the correction pulse FP for correcting the rotation error (Step S7). The subsequent steps from Step S7 to Step S11 are the same as those of the first embodiment, and hence descriptions thereof are omitted here.

As described above, according to the modification example of the first embodiment, in order to detect the well of the current waveform i, the second detection segment G2 for detecting the well is divided into a plurality of segments with the divided detection segments being formed so as to cover another adjacent detection segment, to thereby be able to prevent a counting error in the detection signal, detect the rotation state of the rotor 31 with high resolution power, and finely control the normal pulse SP.

For example, FIG. 8(*b*) indicates an example in which the second piece of the second detection signal DS2 within the second segment first half G2*a* and the third piece of the second detection signal DS2 within the second segment middle G2*c* have been detected. Even when the well has been detected over the two detection segments, the adjacent detection segments are formed so as to cover each other, and hence the rotation detector circuit 40 counts the number of times of detection correctly (in this case, counts that the two signals have been detected within the second segment middle G2*c*), to thereby be able to select the driving interval TS of the normal pulse SP optimally.

That is, the adjacent detection segments are formed so as to cover each other, and the driving interval of the normal pulse SP is set based on the detection result within each of the detection segments. Therefore, even when there is a slight change in the detection position of the well, it is possible to positively detect the change, and to finely select the driving interval TS of the normal pulse SP with high precision. In the configuration exemplified in this case, the two detection segments are formed so as to cover each other, but the present invention is not limited thereto. For example, three detection segments may be formed so as to cover of one another. Further, there are no limitations imposed on the number of divisions of a detection segment.

This embodiment is described by taking the example in which the second detection segment G2 for detecting the well is divided into a plurality of segments to be formed so as to cover another adjacent detection segment, but such a configuration is not limited to the second detection segment. For example, the first detection segment G1 for detecting the bell may be divided into a plurality of segments to be formed so as to cover another adjacent detection segment.

Second Embodiment

Figure 9:
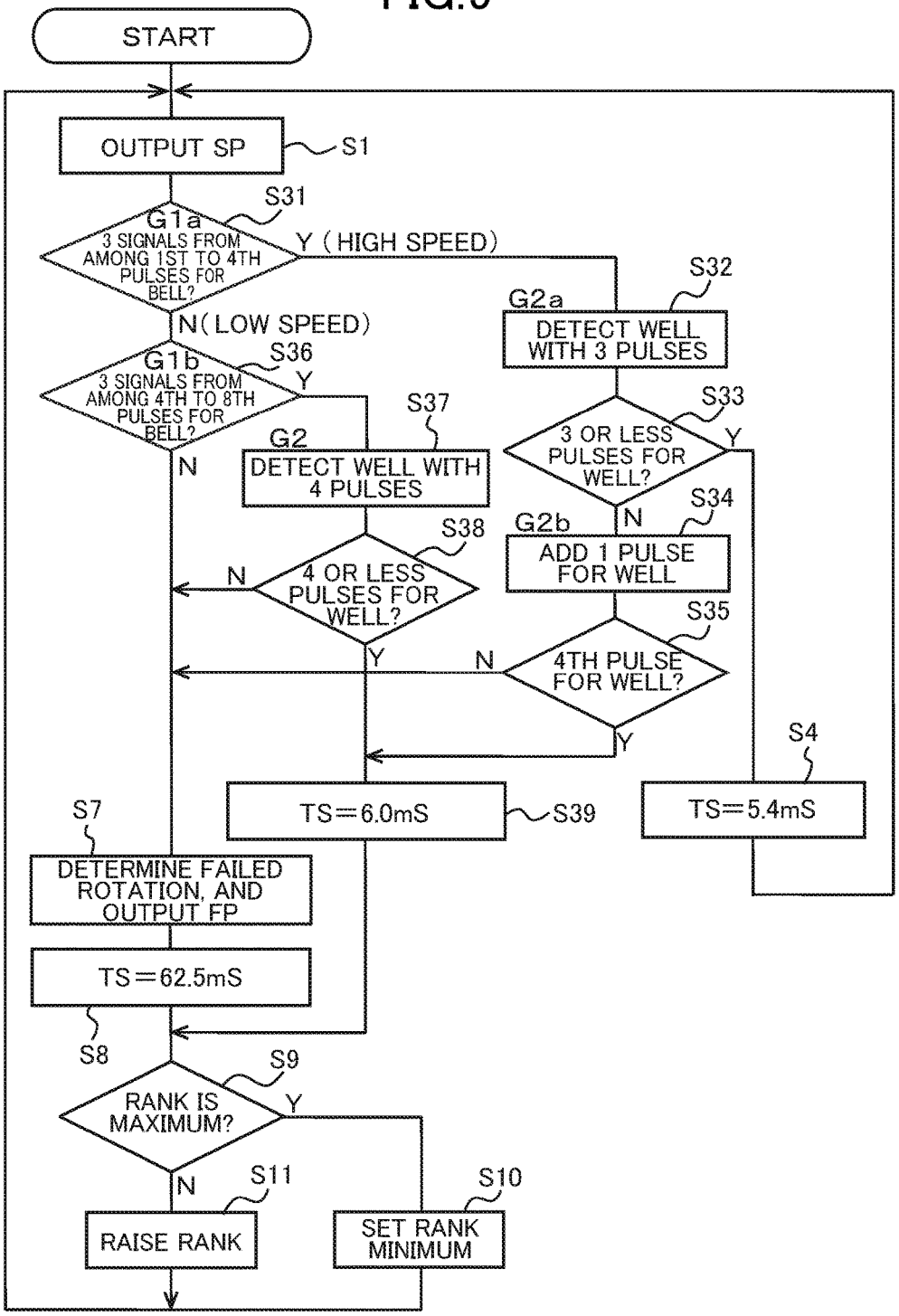
FIG. 9 is a flowchart for illustrating a rotation detection operation for the electronic watch according to a second embodiment of the present invention.
Figure 10:
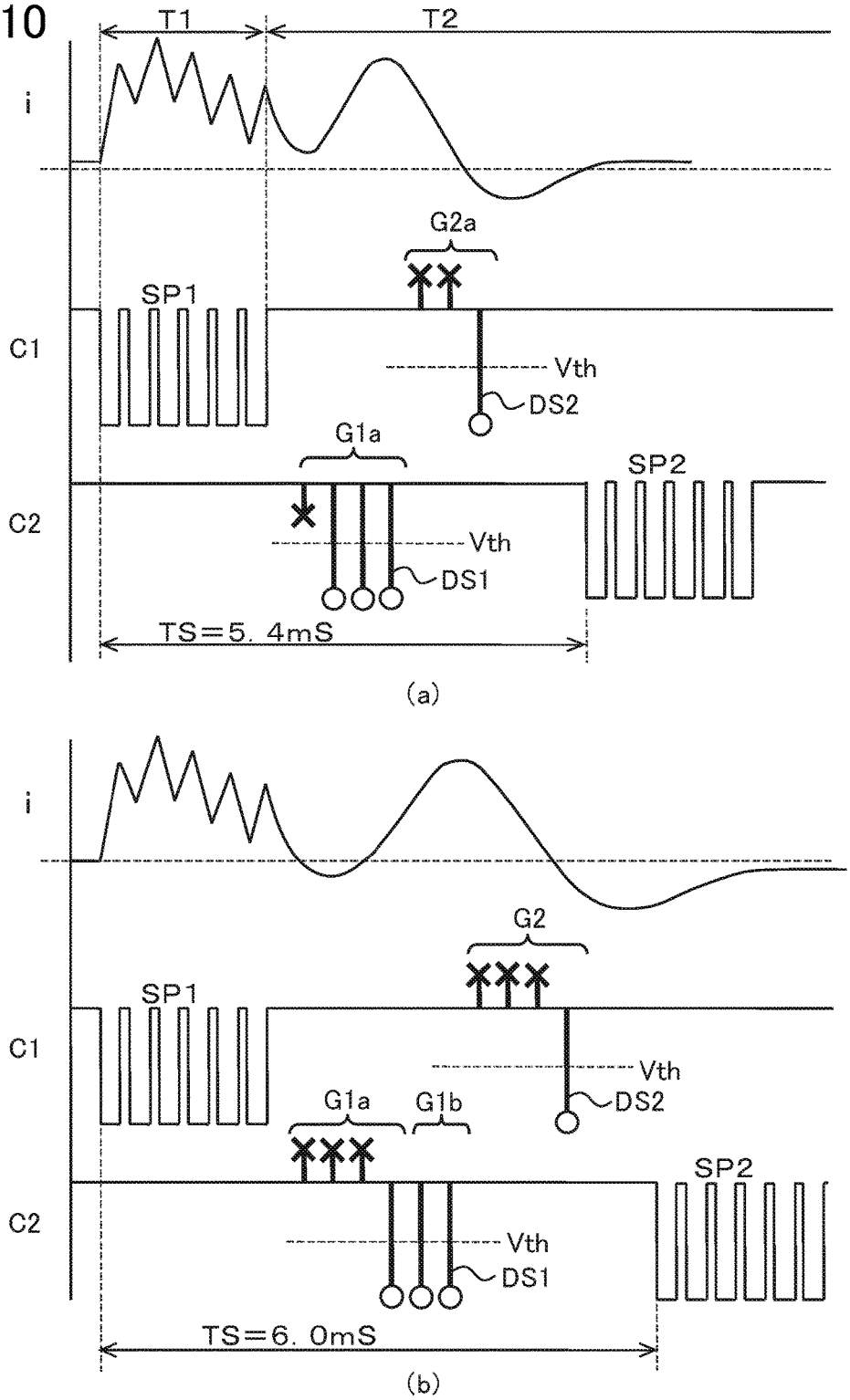
FIG. 10 are timing charts for illustrating the rotation detection operation for the electronic watch according to the second embodiment of the present invention.

[Description of Rotation Detection Operation According to Second Embodiment: FIG. 9 and FIGS. 10]

Next, rotation detection conducted in a fast-forward operation of a step motor according to the second embodiment is described with reference to the flowchart of FIG. 9 and the timing charts of FIG. 10. The second embodiment has a feature that the bell of the counter-electromotive force generated from the step motor is divided into two detection segments, and a selection is made from a high-speed detection mode and a low-speed detection mode depending on a detection result thereof, to thereby be able to detect the rotation state of the rotor quickly and widely. An electronic watch according to the second embodiment has the same configuration as that of the electronic watch according to the first embodiment, and hence the configuration is described with reference to FIG. 1.

In this case, the timing charts of FIG. 10 have the same structure as that of the timing charts (FIG. 5 and FIG. 6) according to the first embodiment described above. FIG. 10(*a*) relates to the case where the driving interval TS of the normal pulse SP is set to approximately 5.4 mS, and FIG. 10(*b*) relates to the case where the driving interval TS of the normal pulse SP is set to approximately 6.0 mS. The description is made based on the premise that the step motor 30 is in a fast-forward operation. Of the respective steps of FIG. 9, the steps within the same operation as that of the flowchart of FIG. 4 according to the first embodiment described above are denoted by like reference symbols, and a detailed description thereof is omitted.

In FIG. 9, the normal pulse SP is generated from the normal pulse generator circuit 5, and is supplied to the step motor 30 to drive the step motor 30 (Step S1).

Subsequently, the first detection pulse generator circuit 11 outputs four first detection pulses DP1 for detecting the bell, which define the first segment first half G1*a*, and the first detection determination circuit 41 determines whether or not the bell has been detected by three first detection signals DS1 from among the four first detection pulses DP1 (Step S31). In this case, when the determination is positive (the well has been detected by three signals), the procedure advances to Step S32, and when the determination is negative (the well has not been detected), the procedure advances to Step S36. In this case, FIG. 10(*a*) indicates that the well has been detected with Vth being exceeded by a total of three pieces from the second to fourth pieces of the first detection signal DS1 generated in the first segment first half G1*a* after the end of the driven period T1 and the start of the damped period T2 (three pieces of DS1 are indicated by "○").

Subsequently in FIG. 9, when the determination is positive in Step S31, the operation proceeds to the detection of the well in the high-speed detection mode on the assumption that the rotation of the rotor 31 is maintaining high momentum, and the second detection pulse generator circuit 12 outputs three second detection pulses DP2 in order to detect the well as the second segment first half G2*a* (Step S32).

Subsequently, the second detection determination circuit 42 determines whether or not the well has been detected by one or more second detection signals DS2 with three or less second detection pulses DP2 (Step S33). In this case, when the determination is positive (the well has been detected by one or more signals), the procedure advances to Step S4, and when the determination is negative (there is no such detection), the procedure advances to Step S34. In this case, FIG. 10(*a*) indicates that the third piece of the second detection signal DS2 has been detected with Vth being exceeded within the second segment first half G2*a* during the damped period T2 (the third piece of DS2 is indicated by "○").

Subsequently in FIG. 9, when the determination is positive in Step S33, the rotation detector circuit 40 uses the frequency selection signal P5 to instruct the frequency selection circuit 4 to select such a frequency that the driving interval TS of the normal pulse SP becomes approximately 5.4 mS being the fastest speed (Step S4). As a result, as illustrated in FIG. 10(*a*), the normal pulse SP2 subsequent to the normal pulse SP1 supplied to the input terminal C1 is supplied to the input terminal C2 after the lapse of (driving interval TS)=(approximately 5.4 mS).

Then, the procedure returns from Step S4 to Step S1. Therefore, when the determination is always positive in Step S31 and Step S33, the processing of from Step S1 to Step S4 is continued, and the normal pulse SP keeps being output at the highest speed of (driving interval TS)=(approximately 5.4 mS), which allows the step motor 30 to continue the rotation at the highest speed.

In this case, the reason why the normal pulse SP is output at the highest speed is that the rotation of the rotor 31 can be determined to be smooth with high momentum and that the step motor 30 can be determined to be ready to undergo rotation drive at the highest speed based on the fact that the bell has been detected with three pulses within the first segment first half G1*a* of Step S31 and the well has been detected with three or less pulses within the second segment first half G2*a* of the subsequent Step S33.

Subsequently in FIG. 9, when the determination is negative in Step S33, in order to continue the detection of the well, the second detection pulse generator circuit 12 additionally outputs one second detection pulse DP2 as the second segment second half G2*b* (Step S34).

Subsequently, the second detection determination circuit 42 determines whether or not the second detection signal DS2 has been detected with respect to the additionally output second detection pulse DP2 as the second segment second half G2*b* for continuing the detection of the well (that is, whether or not the well has been detected with the fourth pulse) (Step S35). In this case, when the determination is positive (the well has been detected), the procedure advances to Step S39. When the determination is negative (the well has not been detected), the rotation is determined to have failed, and the procedure advances to Step S7.

In Step S34, only one second detection pulse DP2 is output within the second segment second half G2*b*, but the number of second detection pulses DP2 is not limited to one. For example, two second detection pulses DP2 may be output to determine in the subsequent Step S35 whether or not one pulse has been detected out of the two pulses. In this case, the detection condition for the well is relaxed, and the probability that the rotation is determined to have failed is reduced, but a time period required for the rotation detection becomes longer (time period for one detection pulse increases).

Subsequently in FIG. 9, when the determination is negative in Step S31, on the assumption that the rotation of the rotor 31 does not maintain high momentum, the first detection pulse generator circuit 11 additionally outputs four first detection pulses DP1 for detecting the bell as the first segment second half G1*b* in order to continue the detection of the bell in the low-speed detection mode, and the first detection determination circuit 41 determines whether or not the bell has been detected by three first detection signals DS1 from among the fourth to eighth pieces of the first detection pulse DP1 (Step S36). In this case, when the determination is positive (the bell has been detected by three signals), the procedure advances to Step S37. When the determination is negative (there is no such detection), the rotation is determined to have failed, and the procedure advances to Step S7.

In this case, FIG. 10(*b*) indicates that the first segment first half G1*a* and the first segment second half G1*b* are effected after the end of the driven period T1 and after the start of the damped period T2, and the three first detection signals DS1 of from the fourth to sixth pieces have been detected with Vth being exceeded (three pieces of DS1 are indicated by "○"). When the determination is positive in Step S36, the output of a further first detection signal DS1 is stopped, and the procedure immediately advances to Step S37 (in the example of FIG. 10(*b*), the seventh to eighth pieces of the first detection signal DS1 are stopped).

Subsequently in FIG. 9, when the determination is positive in Step S36, the operation proceeds to the detection of the well, the second detection pulse generator circuit 12 outputs four second detection pulses DP2 to detect the well as the second detection segment G2 (Step S37).

Subsequently, the second detection determination circuit 42 determines whether or not the well has been detected by one or more second detection signals DS2 with four or less second detection pulses DP2 (Step S38). In this case, when the determination is positive (the well has been detected by one or more signals), the procedure advances to Step S39. When the determination is negative (there is no such detection), the rotation is determined to have failed, and the procedure advances to Step S7. In this case, FIG. 10(*b*) indicates that the fourth piece of the second detection signal DS2 has been detected with Vth being exceeded within the second detection segment G2 during the damped period T2 (the fourth piece of DS2 is indicated by ("○").

Subsequently in FIG. 9, when the determination is positive in Step S38, the rotation detector circuit 40 uses the frequency selection signal P5 to instruct the frequency selection circuit 4 to select such a frequency that the driving interval TS of the normal pulse SP becomes approximately 6.0 mS, which is slower than the highest speed (Step S39). As a result, as illustrated in FIG. 10(*b*), the normal pulse SP2 subsequent to the normal pulse SP1 supplied to the input terminal C1 is supplied to the input terminal C2 after the lapse of (driving interval TS)=(approximately 6.0 mS). Subsequently to Step S39, the procedure advances to Step S9. Further, Step S39 is executed even when the determination is positive in Step S35 as described above.

In this manner, the condition that the driving interval TS of the normal pulse SP is set to approximately 6.0 mS, which is slower than the highest speed, is a case where the bell has been detected with three pulses within the first segment first half G1*a* (Step S31) and the well has been detected with one pulse within the second segment second half G2*b* (Step S35) and a case where the bell has been detected with three pulses within the first segment second half G1*b* (Step S36) and the well has been detected with four or less second detection segments G2 (Step S38).

The reason for the above-mentioned condition is that the rotation of the rotor 31 can be determined to be somewhat slow due to some factor when the detection of the succeeding well is late (the well is detected within the second segment second half G2*b*) even after the bell is detected within the first segment first half G1*a* (from the first to fourth pulses) or when the bell is detected within the first segment second half G1*b* (from the fourth to eighth pulses). That is, in the case where the rotation of the rotor 31 is slow with little momentum, when the normal pulse SP is supplied at the highest speed, a rotation error may be caused in the rotor 31, and hence the driving interval TS of the normal pulse SP is selected depending on the rotation state of the rotor 31, to thereby prevent the rotation error.

Subsequently in FIG. 9, when the determination is negative in Steps S35, S36, and S38, the rotation of the rotor 31 is determined to have failed, and Steps S7 to S11 are executed. Therefore, the generation of a further detection pulse is stopped, the correction pulse FP is output, a driven period TS of the normal pulse SP is set to approximately 62.5 mS, the rank of the duty cycle of the normal pulse SP is adjusted as well, and the procedure returns to Step S1. The above-mentioned series of processing is the same as that of the flow of the first embodiment illustrated in FIG. 4, and hence a detailed description thereof is omitted.

As described above, according to the second embodiment, the detection position of the bell due to the counter-electromotive force generated from the step motor 30 is detected with the two divided detection segments, and a selection is made from the high-speed detection mode and the low-speed detection mode based on a detection result thereof. Therefore, even when variations in the rotation of the rotor 31 cause a large change in the bell of the current waveform i due to the counter-electromotive force, the change can be detected quickly and widely, and hence it is possible to provide an electronic watch that achieves an appropriate fast-forward operation.

That is, according to this embodiment, the detection is conducted by dividing the first detection segment G1 for detecting the bell into the two detection segments (G1*a* and G1*b*) in the first half and the second half, and the rotation state of the rotor 31 is quickly predicted based on the detection position of the bell, to thereby be able to increase the speed of proceeding to high-speed rotation by executing the high-speed detection mode when it is assumed that the rotation is maintaining high momentum. When it is assumed based on the detection position of the bell that the rotation of the rotor 31 is maintaining little momentum, the operation proceeds to the low-speed detection mode to widely set detection ranges of the bell and the well, to thereby be able to handle even large rotation variations of the rotor 31.

Third Embodiment

Figure 11:
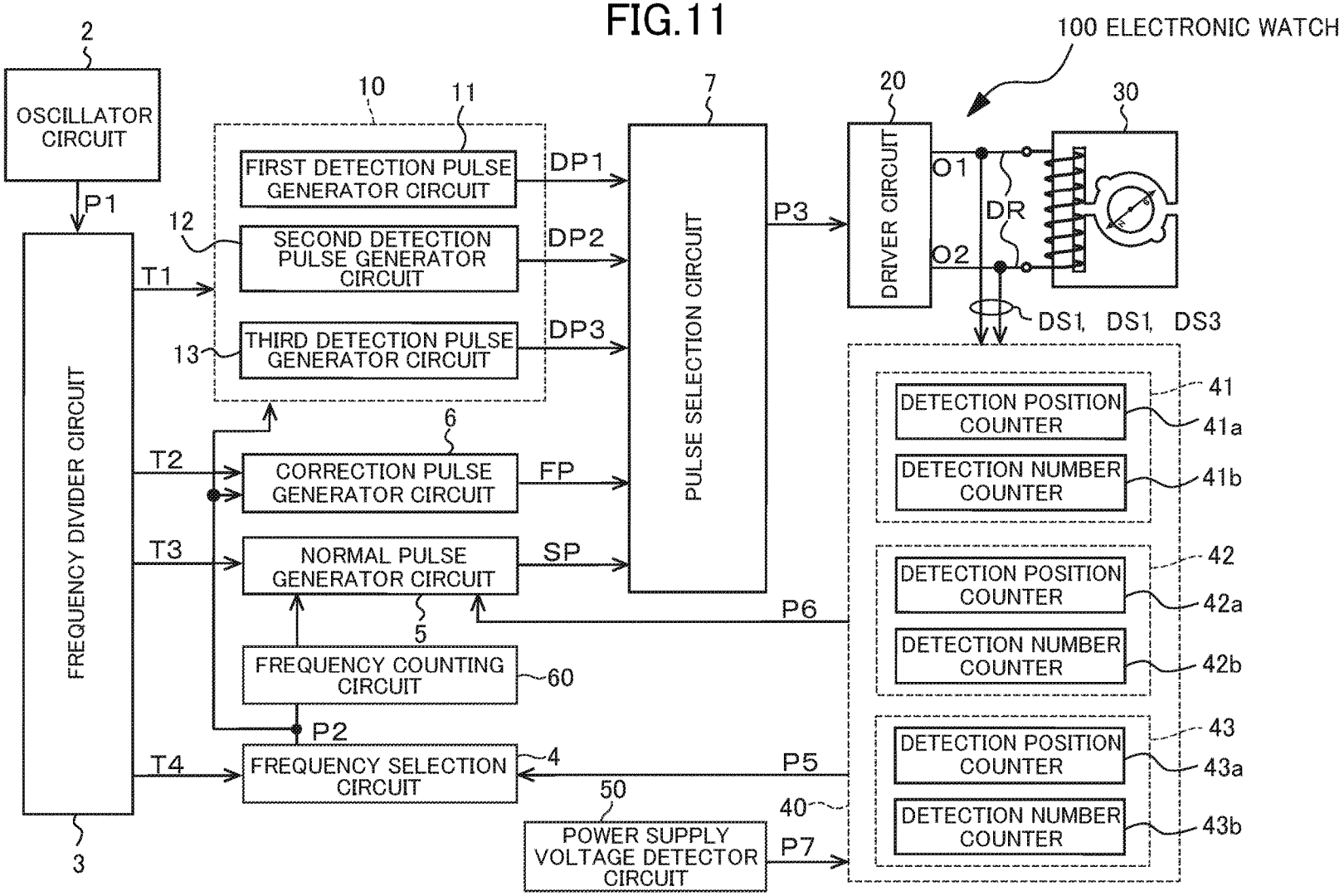
FIG. 11 is a block diagram for illustrating a schematic configuration of an electronic watch according to a third embodiment of the present invention.

[Description of Configuration of Electronic Watch According to Third Embodiment: FIG. 11]

Next, a schematic configuration of an electronic watch according to the third embodiment is described with reference to FIG. 11. The third embodiment relates to a configuration for detecting the dummy, the bell, and the well of the counter-electromotive force generated from the step motor with three divided detection segments, and has a feature that the rotation state of the rotor is assumed based on presence or absence of the dummy to prioritize high-speed rotation drive. A basic configuration of the electronic watch according to the third embodiment is analogous to the configuration of the first embodiment illustrated in FIG. 1, and hence only added components are described here, while like components are denoted by like reference symbols, and duplicate descriptions are omitted.

In FIG. 11, reference numeral 100 represents the electronic watch according to the third embodiment. The electronic watch 100 includes the oscillator circuit 2, the frequency divider circuit 3, the frequency selection circuit 4, the normal pulse generator circuit 5, the correction pulse generator circuit 6, the detection pulse generator circuit 10, the pulse selection circuit 7, the driver circuit 20, the step motor 30, the rotation detector circuit 40, a power supply voltage detector circuit 50, and a frequency counting circuit 60.

The detection pulse generator circuit 10 includes a third detection pulse generator circuit 13 distinctive to the third embodiment. The third detection pulse generator circuit 13 is configured to output the third detection pulse DP3 for detecting the dummy that occurs immediately after the normal pulse SP due to the counter-electromotive force generated when the step motor 30 is driven with the normal pulse SP.

The rotation detector circuit 40 includes a third detection determination circuit 43 distinctive to the third embodiment. The third detection determination circuit 43 includes: a third detection position counter 43*a* configured to input the third detection signal DS3 generated by the third detection pulse DP3 and to examine a detection position, and a third detection number counter 43*b* configured to input the third detection signal DS3 in the same manner and to examine the number of times of detection.

Further, reference numeral 50 represents a power supply voltage detector circuit serving as a factor detection circuit, and is configured to detect a voltage of a battery or the like (not shown) serving as a power source of the electronic watch 100, and to output, when the voltage has become equal to or lower than a predetermined level, a voltage LOW signal P7 for notifying to that effect to the rotation detector circuit 40. An operation of the power supply voltage detector circuit 50 is described later.

The frequency counting circuit 60 is configured to count the number of outputs of the normal pulse SP having the same duty cycle. A rank signal for selecting the rank of the duty cycle of the normal pulse SP based on the number of outputs counted by the frequency counting circuit 60 is supplied to the normal pulse generator circuit 5 along with the driving interval control signal P2 output by the frequency selection circuit 4.

Figure 12:
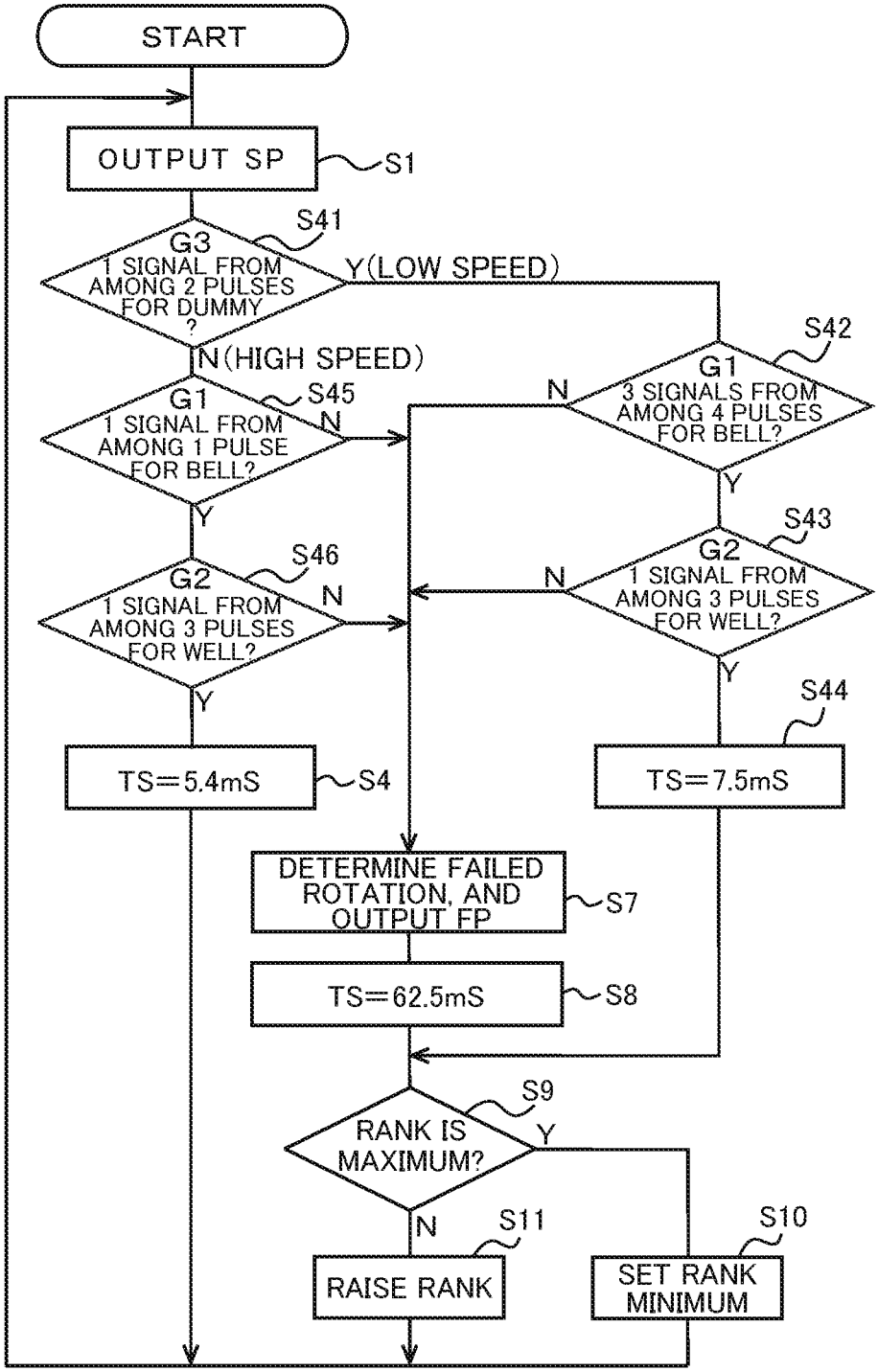
FIG. 12 is a flowchart for illustrating a rotation detection operation for the electronic watch according to the third embodiment of the present invention.
Figure 13:
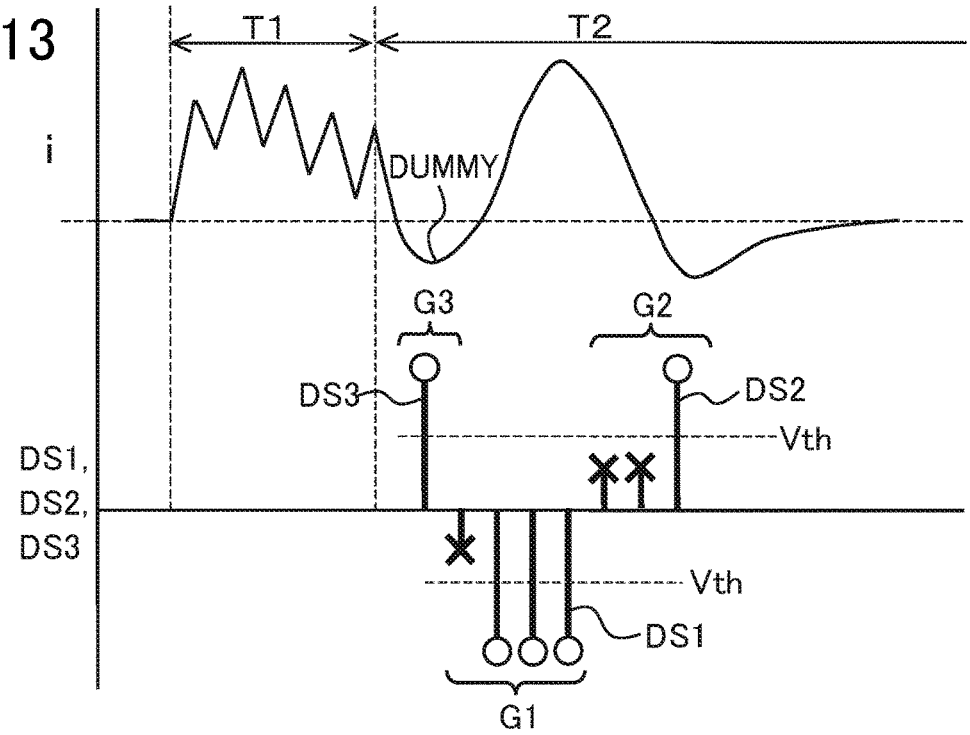
FIG. 13 are timing charts for illustrating the rotation detection operation for the electronic watch according to the third embodiment of the present invention.
Figure 13:
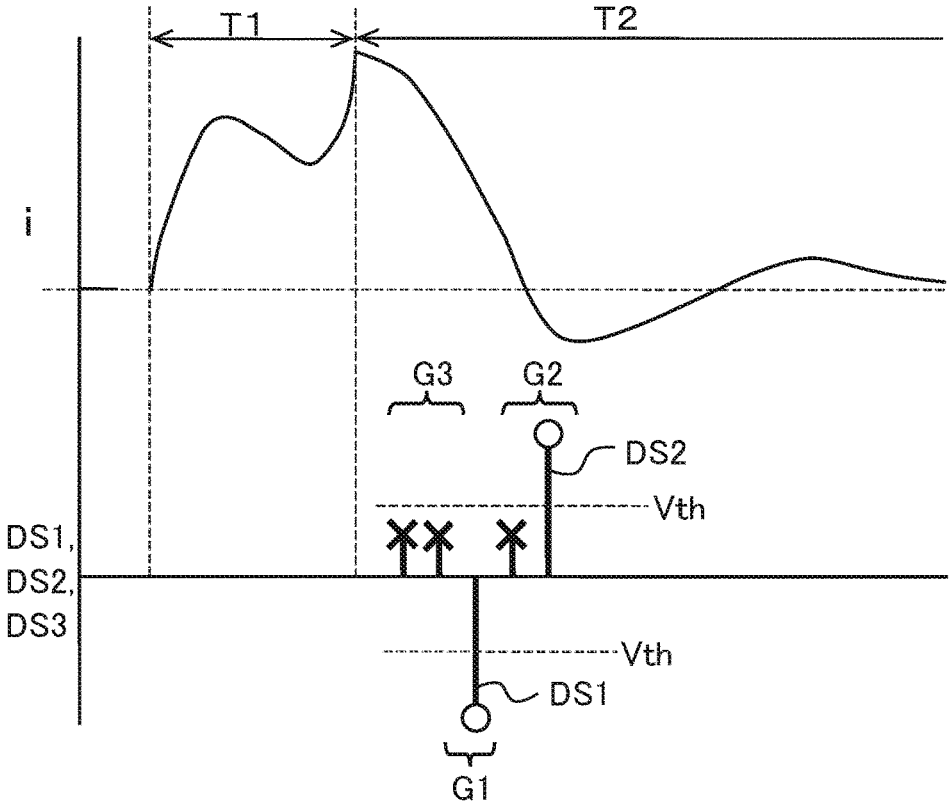

[Description of Rotation Detection Operation According to Third Embodiment: FIG. 12 and FIGS. 13]

Next, the rotation detection operation conducted in the fast-forward operation for the step motor according to the third embodiment is described with reference to the flowchart of FIG. 12 and the timing charts of FIG. 13. In this case, the timing charts of FIG. 13 are schematic illustrations of examples of the current waveform i due to the counter-electromotive force generated from the step motor 30 and the first, second, and third detection signals DS1, DS2, and DS3 generated in the input terminals C1 and C2 of the step motor 30.

Then, FIG. 13(*a*) is an illustration of an example in which a dummy exists in the current waveform i, and FIG. 13(*b*) is an illustration of an example in which no dummy exists in the current waveform i. With the electronic watch 100 having the configuration described with reference to FIG. 11, the description is made based on the premise that the step motor 30 is in a fast-forward operation. Of the respective steps of FIG. 12, the steps within the same operation as that of the flowchart of FIG. 4 according to the first embodiment described above are denoted by like reference symbols, and a detailed description thereof is omitted.

In FIG. 12, the normal pulse SP is generated from the normal pulse generator circuit 5, and is supplied to the step motor 30 to drive the step motor 30 (Step S1).

Subsequently, the third detection pulse generator circuit 13 outputs two third detection pulses DP3 for detecting the dummy, which define the third detection segment G3, and the third detection determination circuit 43 determines whether or not the dummy has been detected by one third detection signal DS3 from among two third detection pulses DP3 (Step S41). In this case, when the determination is positive (the dummy has been detected), the procedure advances to Step S42, and when the determination is negative (there is no such detection), the procedure advances to Step S45.

In this case, FIG. 13(*a*) indicates that the first piece of the third detection signal DS3 has been detected with Vth being exceeded within the third detection segment G3 after the end of the driven period T1 and immediately after the start of the damped period T2 (one piece of DS3 is indicated by "○"). When the first piece of the third detection signal DS3 has been detected, the procedure immediately advances to the subsequent steps without outputting the second piece of the third detection pulse DP3.

Subsequently in FIG. 12, when the determination is positive in Step S41, the operation proceeds to the detection of the bell in the low-speed detection mode on the assumption that the rotation of the rotor is slow with little momentum, the first detection pulse generator circuit 11 outputs four first detection pulses DP1 for detecting the bell as the first detection segment G1, and the first detection determination circuit 41 determines whether or not three first detection signals DS1 have been detected from among four first detection pulses DP1 (Step S42). In this case, when the determination is positive (three signals have been detected), the procedure advances to Step S43. When the determination is negative (there is no such detection), the rotation is determined to have failed, and the procedure advances to Step S7. In this case, FIG. 13(*a*) indicates that three first detection signals DS1 of from the second to fourth pieces have been detected with Vth being exceeded within the first detection segment G1 during the damped period T2 (three pieces of DS1 are indicated by "○").

Subsequently in FIG. 12, when the determination is positive in Step S42, the operation proceeds to the detection of the well, the second detection pulse generator circuit 12 outputs three second detection pulses DP2 for detecting the well as the second detection segment G2, and the second detection determination circuit 42 determines whether or not one or more second detection signals DS2 have been detected with three or less second detection pulses DP2 (Step S43). In this case, when the determination is positive (one or more signals have been detected with three or less pulses), the procedure advances to Step S44. When the determination is negative (one or more signals have not been detected), the rotation is determined to have failed, and the procedure advances to Step S7. In this case, FIG. 13(*a*)

indicates that the third piece of the second detection signal DS2 has been detected with Vth being exceeded within the second detection segment G2 (the third piece of DS2 is indicated by "○").

Subsequently in FIG. 12, when the determination is positive in Step S43, the rotation detector circuit 40 uses the frequency selection signal P5 to instruct the frequency selection circuit 4 to select such a frequency that the driving interval TS of the normal pulse SP becomes, for example, approximately 7.5 mS, which is a moderate speed slower than the highest speed (Step S44). As a result, the frequency selection circuit 4 supplies the driving interval control signal P2 having the driving interval TS of approximately 7.5 mS to the normal pulse generator circuit 5, and hence, although not shown, the subsequent normal pulse SP is output after the lapse of approximately 7.5 mS. Then, as processing to be conducted subsequently to Step S44, the procedure advances to Step S9 to adjust the rank of the normal pulse SP.

In this case, the reason why the driving interval TS of the normal pulse SP is made slower than the highest speed is that the dummy has been detected within the third detection segment G3 of Step S41. That is, as described above, the dummy of the current waveform i appears when the rotor 31 has not finished being rotated by 180-θi degrees as illustrated in FIG. 2(*a*) (when the rotation of the rotor is slow) even after the driving pulse SP has ended. Therefore, the rotation of the rotor 31 is determined to be slow because the dummy has been detected, and hence a driving interval slower than the highest speed is set.

Subsequently in FIG. 12, when the determination is negative in Step S41, the operation proceeds to the detection of the bell in the high-speed detection mode on the assumption that the rotation of the rotor 31 is fast with high momentum, the first detection pulse generator circuit 11 outputs one first detection pulse DP1 for detecting the bell as the first detection segment G1, and the first detection determination circuit 41 determines whether or not one first detection signal DS1 has been detected with the first detection pulse DP1 (Step S45). In this case, when the determination is positive (one signal has been detected) the procedure advances to Step S46. When the determination is negative (there is no such detection), the rotation is determined to have failed, and the procedure advances to Step S7. In this case, FIG. 13(*b*) indicates that the dummy has not been detected within the third detection segment G3 immediately after the start of the damped period T2, and after that, one first detection signal DS1 has been detected with Vth being exceeded within the first detection segment G1 (one piece of DS1 is indicated by "○").

Subsequently in FIG. 12, when the determination is positive in Step S45, the operation proceeds to the detection of the well, the second detection pulse generator circuit 12 outputs three second detection pulses DP2 for detecting the well as the second detection segment G2, and the second detection determination circuit 42 determines whether or not one or more second detection signals DS2 have been detected with three or less second detection pulses DP2 (Step S46). In this case, when the determination is positive (one or more signals have been detected with three or less pulses), the procedure advances to Step S4. When the determination is negative (one or more signals have not been detected), the rotation is determined to have failed, and the procedure advances to Step S7. In this case, FIG. 13(*b*) indicates that the second piece of the second detection signal DS2 has been detected with Vth being exceeded within the second detection segment G2 (the second piece of DS2 is indicated by "○").

Subsequently in FIG. 12, when the determination is positive in Step S46, the rotation detector circuit 40 uses the frequency selection signal P5 to instruct the frequency selection circuit 4 to select such a frequency that the driving interval TS of the normal pulse SP becomes, for example, approximately 5.4 mS, which is the highest speed (Step S4). As a result, the frequency selection circuit 4 supplies the driving interval control signal P2 having the driving interval TS of approximately 5.4 mS to the normal pulse generator circuit 5, and hence, although not shown, the subsequent normal pulse SP is output after the lapse of approximately 5.4 mS.

In this case, the reason why the driving interval TS of the normal pulse SP is made the highest speed is that the dummy has not been detected within the third detection segment G3 of Step S41. That is, as described above, the dummy of the current waveform i does not appear when the rotor 31 has finished being rotated by 180-θi degrees (when the rotation of the rotor is fast) during output of the driving pulse SP. Therefore, the rotation of the rotor 31 is determined to be fast because the dummy has not been detected, and hence the driving interval at the highest speed is set.

Then, the procedure returns to Step S1 as processing subsequent to Step S4. Therefore, when the determination continues to be negative in Step S41, and when the determination continues to be positive in Step S45 and Step S46, the processing of from Step S1 to Step S4 is continued, and the normal pulse SP keeps being output at the highest speed of (driving interval TS)=(approximately 5.4 mS), which allows the step motor 30 to continue the rotation at the highest speed.

Subsequently in FIG. 12, when the determination is negative in Steps S42, S43, S45, and S46, the rotation of the rotor 31 is determined to have failed, and Steps S7 to S11 are executed. Therefore, the generation of a further detection pulse is stopped, the correction pulse FP is output, the driven period TS of the normal pulse SP is set to approximately 62.5 mS, the rank of the duty cycle of the normal pulse SP is adjusted, and the procedure returns to Step S1. The above-mentioned series of processing is the same as that of the flow of the first embodiment illustrated in FIG. 4, and hence a detailed description thereof is omitted.

As described above, according to the third embodiment, three phenomena of the dummy, the bell, and the well due to the counter-electromotive force generated from the step motor 30 are detected in order after the normal pulse SP is output, to thereby allow the rotation state of the rotor 31 to be grasped accurately, and it is possible to provide an electronic watch for detecting the rotation state of the step motor 30 with high precision. Further, it is determined whether or not a dummy is present or absent immediately after the output of the normal pulse SP, and when no dummy is detected, the operation proceeds to the high-speed detection mode to execute the detection of the bell for a short period of time (one first detection pulse DP1) on the assumption that the rotation is fast with the rotation of the rotor 31 maintaining high momentum, to thereby carry out processing for prioritizing the high-speed rotation drive of the step motor 30. Therefore, this embodiment relates to drive means for preferentially driving the step motor 30 at the highest speed as much as possible.

Figure 14:
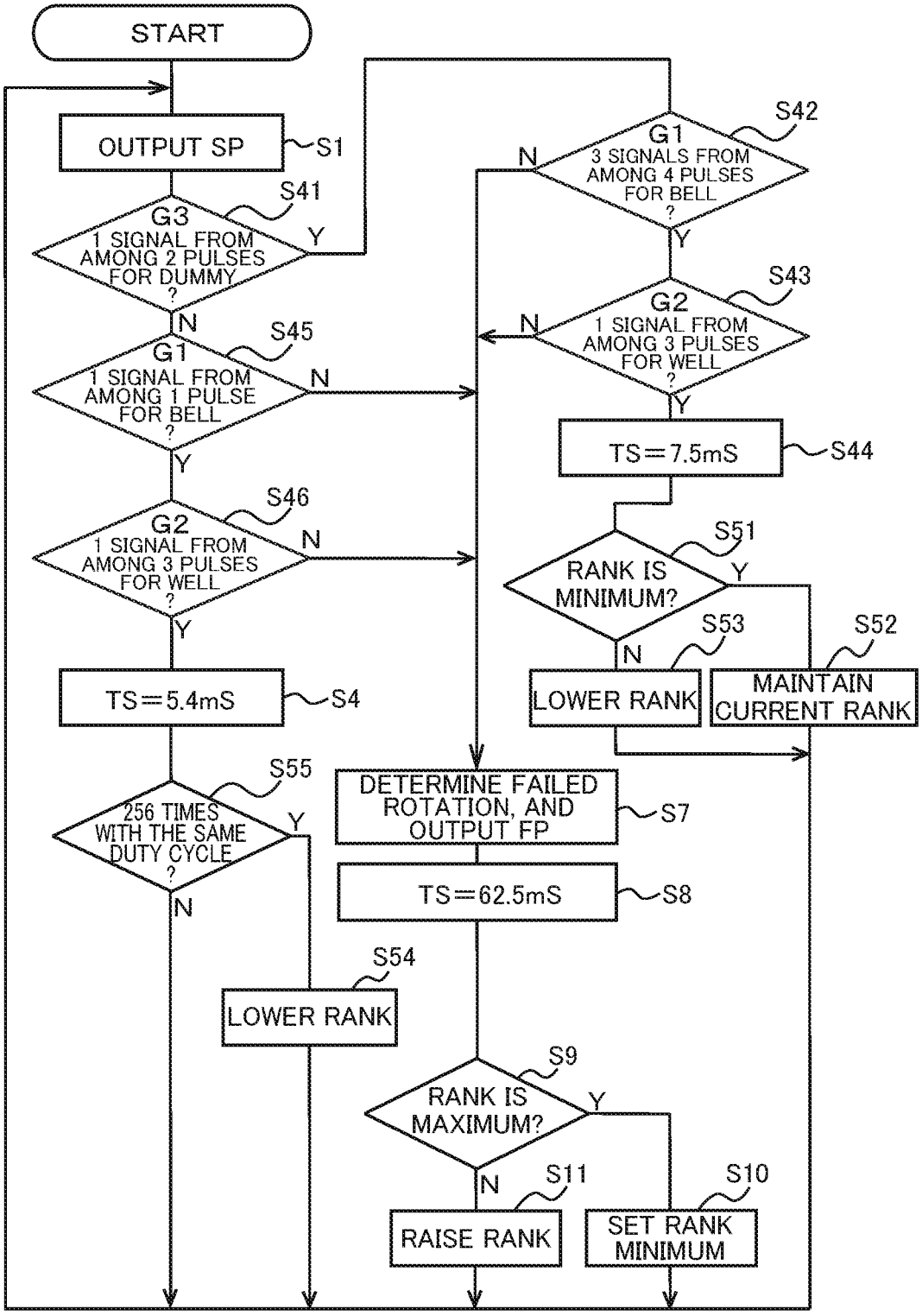
FIG. 14 is a flowchart for illustrating a rotation detection operation for the electronic watch according to a modification example of the third embodiment of the present invention.

[Description of Rotation Detection Operation According to Modification Example of Third Embodiment; FIG. 14]

Next, rotation detection conducted in a fast-forward operation of a step motor according to a modification example of the third embodiment is described with reference to the flowchart of FIG. 14. The modification example of the third embodiment relates to a configuration for detecting the dummy, the bell, and the well of the counter-electromotive force generated from the step motor with three divided detection segments, and has a feature that the rotation state of the rotor is predicted based on the presence or absence of the dummy to prioritize low-power-consumption drive with the lowered rank of the normal pulse SP.

With the electronic watch 100 having the configuration described with reference to FIG. 11, the timing chart is the same as the timing chart of the third embodiment illustrated in FIG. 13. Of the respective steps of FIG. 14, the steps within the same operation as that of the flowchart of FIG. 4 according to the first embodiment described above are denoted by like reference symbols, and a detailed description thereof is omitted.

In FIG. 14, Step S1, Step S41, Step S42, Step S43, Step S44, Step S45, Step S46, and Step S4 are the same as the processing of the above-mentioned flow of the third embodiment illustrated in FIG. 12, and hence descriptions thereof are omitted.

In this case, after execution of Step S44 for setting the driving interval TS for the step motor 30 to approximately 7.5 mS, the rotation detector circuit 40 determines whether or not the rank of the duty cycle of the normal pulse SP is minimum (Step S51). In this case, when the determination is positive (the rank is minimum), the current rank (that is, minimum rank) is maintained (Step S52). When the determination is negative in Step S51, the lowering of the rank is executed in order to prioritize the low-power-consumption drive as much as possible (Step S53).

Then, the procedure returns to Step S1 after execution of Step S52 or Step S53, and hence when the determination continues to be positive in Step S41, Step S42, and Step S43, the normal pulse SP keeps being output at (driving interval TS)=(approximately 7.5 mS). Then, the step motor 30 continues the rotation at a moderate speed slower than the highest speed, and the rank of the normal pulse SP (that is, duty cycle) is processed to proceed to the minimum rank in order to prioritize the low-power-consumption drive.

Further, after execution of Step S4 for setting the driving interval TS of the normal pulse SP to 5.4 mS being the fastest speed, it is determined whether or not the number of outputs of the normal pulse SP having the same duty cycle, which is counted by the frequency counting circuit 60, has reached 256 (Step S55). In this case, when the determination is positive (the normal pulse SP having the same duty cycle has been output 256 or more times), the procedure returns to Step S1 with the rank being lowered in order to prioritize the low-power-consumption drive (Step S54). When the determination is negative in Step S55, the procedure returns to Step S1 without a change being made to the rank. In place of Step S53 described above, the same processing as that of Steps S55 and S54 may be conducted.

As described above, a basic operation of the modification example of the third embodiment is the same as that of the above-mentioned flow of the third embodiment illustrated in FIG. 12, but whichever of the highest-speed rotation state (approximately 5.4 mS) or the medium-level rotation state (approximately 7.5 mS) the rotor 31 is in, the processing is conducted so that the duty cycle of the normal pulse SP proceeds to as small an extent as possible. Therefore, this embodiment relates to drive means for preferentially conducting the fast-forward drive for the step motor 30 with as low power consumption as possible.

Further, when the rank is lowered after the determination of Step S55 while the normal pulse SP is being driven with the driving interval TS of 5.4 mS being the fastest speed, the driving force of the step motor 30 decreases, and as a result, the rotation speed of the rotor 31 becomes slower. Therefore, it is likely that the determination of dummy determination (Step S41) becomes positive, and the selection of the driving interval TS proceeds to approximately 7.5 mS.

Accordingly, the modification example of the third embodiment also includes control for not only conducting the low-power-consumption drive by the lowering of the rank of the normal pulse SP but also conducting the low-power-consumption drive by causing the driving interval TS of the normal pulse SP to become slower. In this manner, in the modification example of the third embodiment, both drive conditions for the duty cycle and the driving interval TS of the normal pulse SP are changed, to thereby be able to achieve the low-power-consumption drive.

Figure 15:
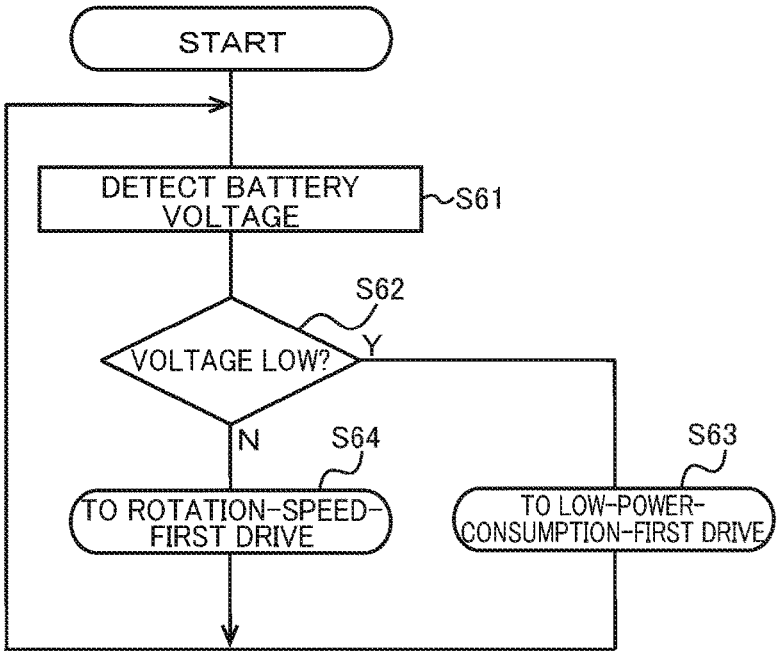
FIG. 15 is a flowchart for illustrating an operation for switching the operations according to the third embodiment of the present invention and the modification example based on a battery voltage.

[Description of Switching Operation through Factor Detection According to Third Embodiment: FIG. 15]

Next, an example of an operation of switching between the above-mentioned two drive means of the third embodiment (rotation-speed-first drive) and the modification example of the third embodiment (low-power-consumption-first drive) through specific factor detection is described with reference to the flowchart of FIG. 15. The description is made here by taking detection of the voltage of the battery serving as a power source of the electronic watch 100 as an example of the factor detection. The configuration is described with reference to the block diagram of the electronic watch 100 according to the third embodiment illustrated in FIG. 11.

In FIG. 15, when the electronic watch 100 proceeds to the fast-forward operation, or during the fast-forward operation, the power supply voltage detector circuit 50 detects the battery voltage of the electronic watch 100 with a predetermined cycle period, and inputs a detection result thereof to the rotation detector circuit 40 as the voltage LOW signal P7 (Step S61).

Subsequently, the rotation detector circuit 40 determines based on the voltage LOW signal P7 whether or not the power supply voltage is equal to or lower than a predetermined voltage (Step S62). In this case, when the determination is positive (the power supply voltage is equal to or lower than the predetermined voltage), it is determined that a capacity of the battery has been lowered, and in order to reduce the power consumption, the operation proceeds to the low-power-consumption-first drive (that is, operation flow of the modification example of the third embodiment illustrated in FIG. 14) (Step S63). Further, when the determination is negative (the power supply voltage is equal to or higher than the predetermined voltage), it is determined that the capacity of the battery is sufficient, and in order to prioritize the high-speed rotation, the operation proceeds to the rotation-speed-first drive (that is, operation flow of the third embodiment illustrated in FIG. 12) (Step S64).

With the above-mentioned operation, the rotation detector circuit 40 instructs the frequency selection circuit 4 on the frequency and instructs the normal pulse generator circuit 5 on the duty cycle, and hence it is possible to provide an electronic watch that achieves appropriate drive of the step motor so as to handle fluctuations in the battery voltage. The factor detection is not limited to the battery voltage. For example, temperature measurement means for measuring the ambient temperature may be provided to switch the drive condition for the step motor 30 depending on a temperature change.

Figure 16:
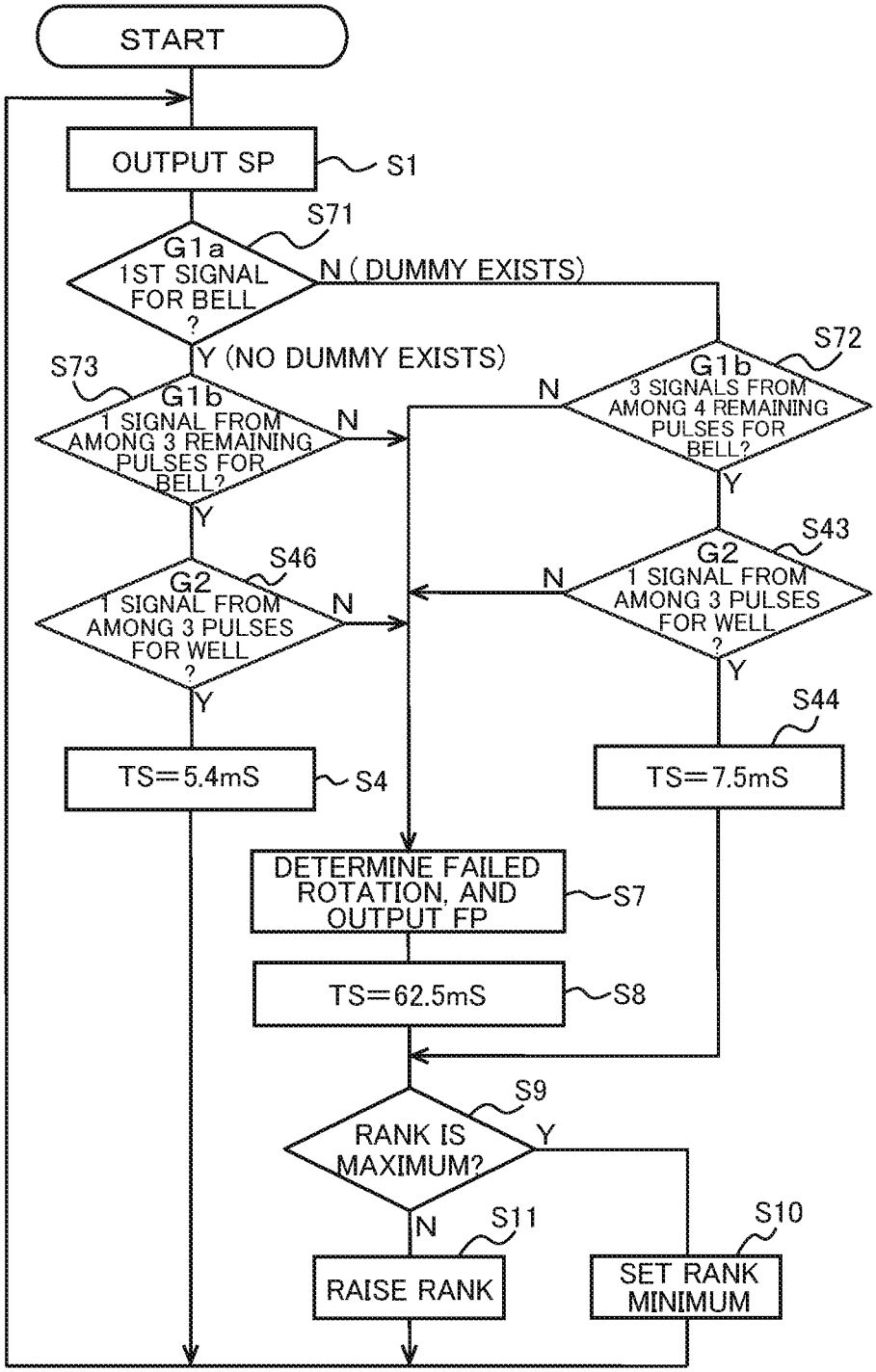
FIG. 16 is a flowchart for illustrating a rotation detection operation for the electronic watch according to another modification example of the third embodiment of the present invention.
Figure 17:
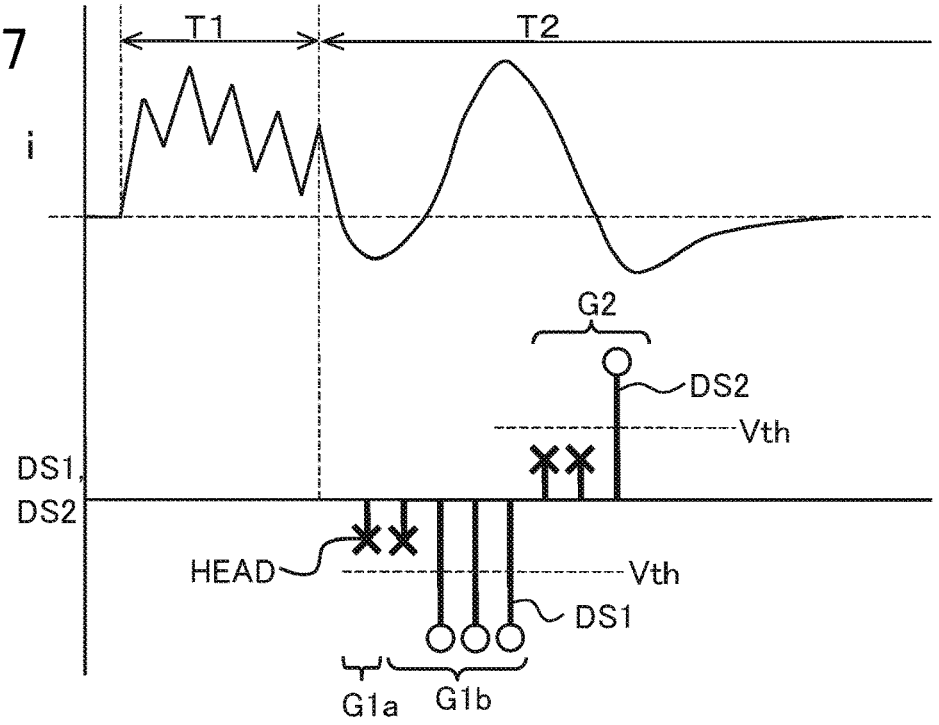
FIG. 17 are timing charts for illustrating the rotation detection operation for the electronic watch according to another modification example of the third embodiment of the present invention.
Figure 17:
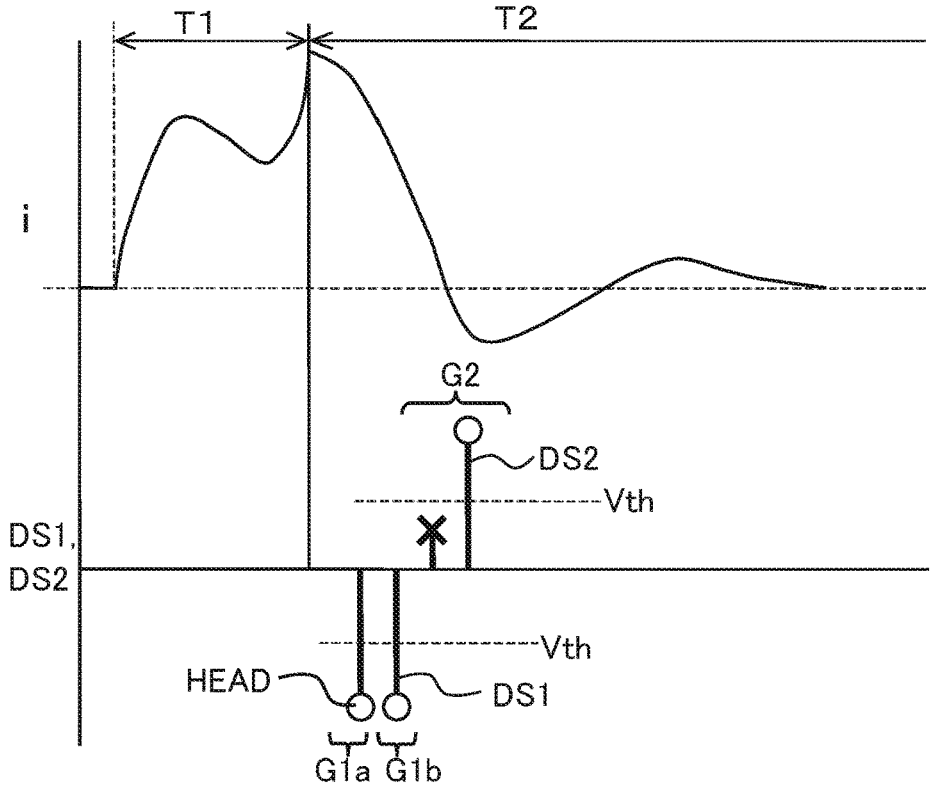

[Description of Rotation Detection Operation According to Another Modification Example of Third Embodiment: FIG. 16 and FIGS. 17]

Next, the rotation detection conducted in the fast-forward operation for the step motor according to another modification example of the third embodiment is described with reference to the flowchart of FIG. 16 and timing charts of FIG. 17. The another modification example of the third embodiment has a feature that the rotation state of the rotor is grasped by predicting presence or absence of an appearance of the dummy based on presence or absence of the detection of the head of the bell of the counter-electromotive force generated from the step motor.

In this case, timing charts of FIG. 17 are schematic illustrations of examples of the current waveform i due to the counter-electromotive force generated from the step motor 30 and the first and second detection signals DS1 and DS2 generated in the input terminals C1 and C2 of the step motor 30. FIG. 17(*a*) is a timing chart for illustrating an example in which the head of the bell fails to be detected (that is, it is predicted that the dummy exists), and FIG. 17(*b*) is the timing chart for illustrating an example in which the head of the bell is successfully detected (that is, it is predicted that no dummy exists).

With the electronic watch 100 having the configuration described with reference to FIG. 11, the description is made based on the premise that the step motor 30 is in a fast-forward operation. Of the respective steps of FIG. 16, the steps within the same operation as that of the flowchart of FIG. 4 according to the first embodiment and the flowchart of FIG. 12 according to the third embodiment described above are denoted by like reference symbols, and a detailed description thereof is omitted.

In FIG. 16, the normal pulse SP is generated from the normal pulse generator circuit 5, and is supplied to the step motor 30 to drive the step motor 30 (Step S1).

Subsequently, in order to detect the head of the bell, the first detection pulse circuit 11 outputs one first detection pulse DP1 as the first segment first half G1*a*, and the first detection determination generator circuit 41 determines whether or not the first piece of the first detection signal DS1 at the head has been detected (Step S71). In this case, when the determination is negative (there is no such detection), the procedure advances to Step S72 on the assumption that there is a dummy (that is, the rotation is slow), and when the determination is positive (the first piece has been detected), the procedure advances to Step S73 on the assumption that there is no dummy (that is, the rotation is fast). In this case, FIG. 17(*a*) indicates that the first piece of the first detection signal DS1 at the head does not exceed Vth within the first segment first half G1*a* immediately after the start of the damped period T2 (the first piece of DS1 is indicated by "x").

Then, in FIG. 16, when the determination is negative in Step S71, it is assumed that the dummy exists and the rotation of the rotor 31 is slow with little momentum, and hence the subsequent detection is set to be conducted in the low-speed detection mode. That is, in order to carry out the detection of the bell positively, the first detection pulse generator circuit 11 outputs four first detection pulses DP1 as the first segment second half G1*b*, and the first detection determination circuit 41 determines whether or not the bell has been detected by three first detection signals DS1 from among the four first detection pulses DP1 (Step S72).

In this case, when the determination is positive (the well has been detected by three signals), the procedure advances to Step S43, and when the determination is negative (there is no such detection), the rotation is determined to have failed and the procedure advances to Step S7. In this case, FIG. 17(*a*) indicates that the three first detection signals have been detected from among the four first detection signals DS1 with Vth being exceeded within the first segment second half G1*b* during the damped period T2 (three out of four pieces of DS1 are indicated by "○").

Subsequently, when the determination is positive in Step S72, the procedure advances to Step S43, and the subsequent processing is the same as that of the flow of the third embodiment illustrated in FIG. 12, and hence descriptions thereof are omitted. However, when the determination is positive in Step S43, (driving interval TS of the normal pulse SP)=(approximately 7.5 mS) is set, and the rank is adjusted in Steps S9 to S1 as well. Therefore, the normal pulse SP is to be output at the driving interval TS being a moderate speed. This is a setting obtained as a result of assuming that the dummy exists because the head of the bell has not been detected and determining that the rotation of the rotor 31 is slower than the highest speed in the later detection.

Then, when the determination is positive in Step S71, it is assumed that the dummy does not exist and the rotation of the rotor 31 is fast with constant momentum, and hence the subsequent detection is set to be conducted in the high-speed detection mode. That is, in order to carry out confirmation of the bell in a short period of time, the first detection pulse generator circuit 11 outputs three first detection pulses DP1 as the first segment second half G1*b*, and the first detection determination circuit 41 determines whether or not the bell has been detected by one first detection signal DS1 from among the three first detection pulses DP1 (Step S73).

In this case, when the determination is positive (the well has been detected by one signal), the procedure advances to Step S46, and when the determination is negative (there is no such detection), the rotation is determined to have failed, and the procedure advances to Step S7. In this case, FIG. 17(*b*) indicates that the first piece of the first detection signal DS1 at the head within the first segment first half G1*a* immediately after the start of the damped period T2 and one more first detection signal DS1 within the succeeding first segment second half G1*b* have been detected with Vth being exceeded (two pieces of DS1 are indicated by "○"). When the first detection signal DS1 is detected within the first segment second half G1*b* in Step S73, the output of a subsequent first detection pulse DP1 is stopped, and the procedure immediately advances to the subsequent Step S46.

Subsequently, when the determination is positive in Step S73, the subsequent processing in Step S46 and subsequent steps is the same as that of the flow of the third embodiment illustrated in FIG. 12, and hence descriptions thereof are omitted. However, when the determination is positive in Step S46, (driving interval TS of the normal pulse SP)=(approximately 5.4 mS) is set, and the normal pulse SP is to be output at the highest speed. This is a setting obtained as a result of assuming that the dummy does not exist because the head of the bell has been detected and determining that the rotation of the rotor 31 is fast in the later detection.

Further, when the determination is negative in Steps S72, S43, S73, and S46, the rotation of the rotor 31 is determined to have failed, and Steps S7 to S11 are executed. Therefore, the generation of a further detection pulse is stopped, the correction pulse FP is output, the driven period TS of the normal pulse SP is set to approximately 62.5 mS, the rank of the duty cycle of the normal pulse SP is adjusted, and the procedure returns to Step S1. The above-mentioned series of processing is the same as that of the flow of the third embodiment illustrated in FIG. 12, and hence a detailed description thereof is omitted.

As described above, according to the another modification example of the third embodiment, the presence or absence of the dummy is assumed based on the presence or absence of the detection of the head of the bell (that is, presence or absence of the detection within the first segment first half G1$a$), to thereby quickly grasp the rotation state of the rotor and determine the driving interval TS of the normal pulse SP, and hence there is no need to detect the dummy, which allows the rotation state of the rotor 31 to be detected at high speed while maintaining high detection accuracy. Therefore, this embodiment is suitable for the electronic watch including the step motor capable of high-speed rotation. Further, this embodiment involves no need to detect the dummy, and hence the configuration of the electronic watch 100 illustrated in FIG. 11 does not need to include the third detection pulse generator circuit 13 or the third detection determination circuit 43, which is advantageous in that a circuit configuration of the electronic watch can be simplified.

Fourth Embodiment

Figure 18:
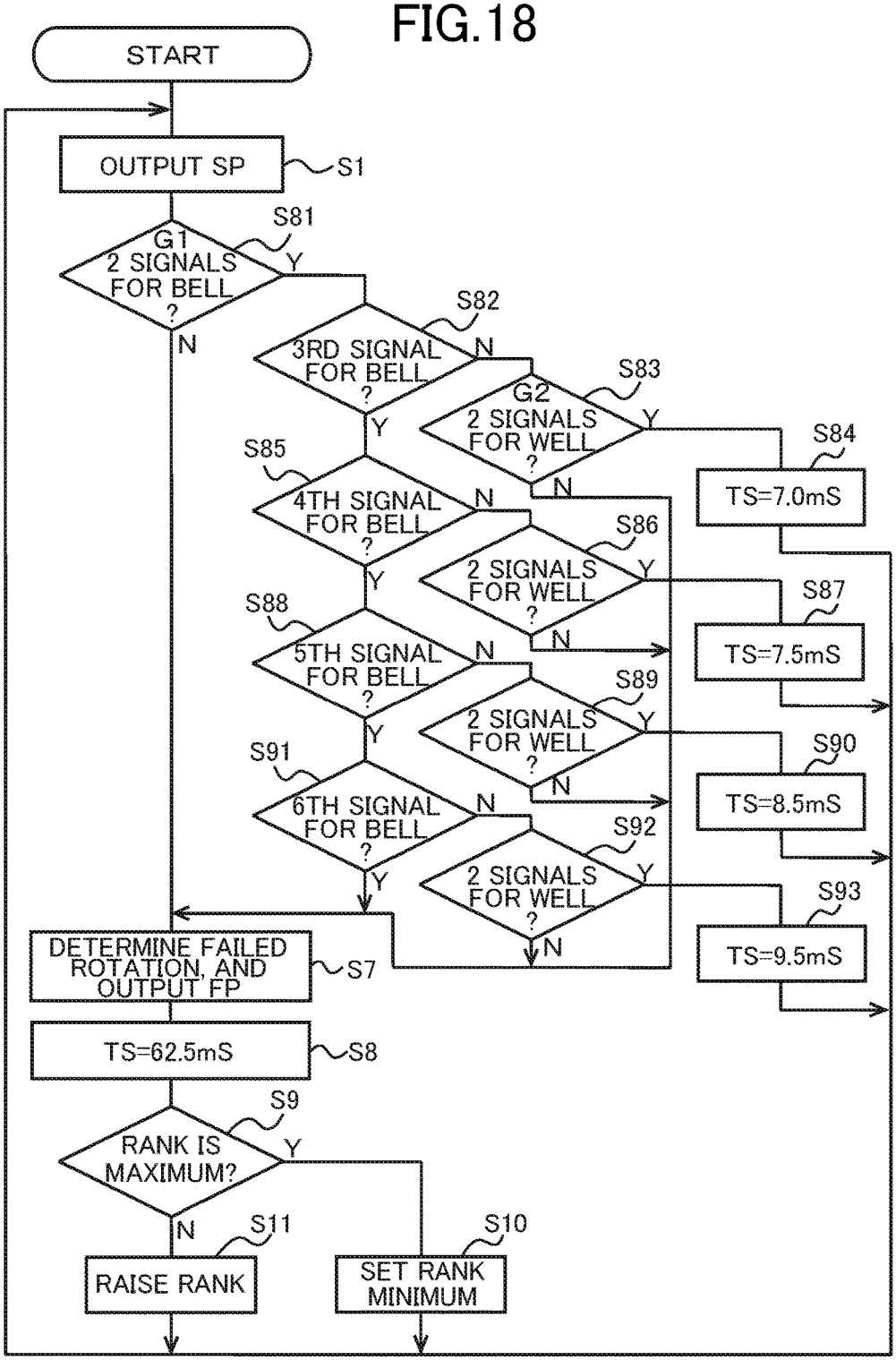
FIG. 18 is a flowchart for illustrating a rotation detection operation for the electronic watch according to a fourth embodiment of the present invention.
Figure 19:
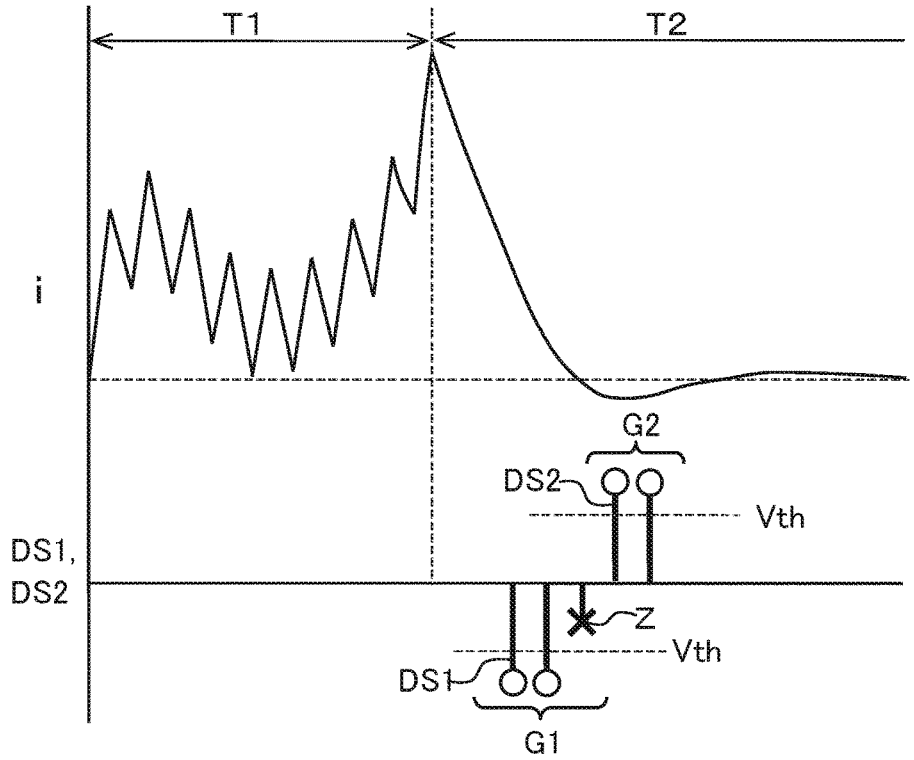
Figure 1:
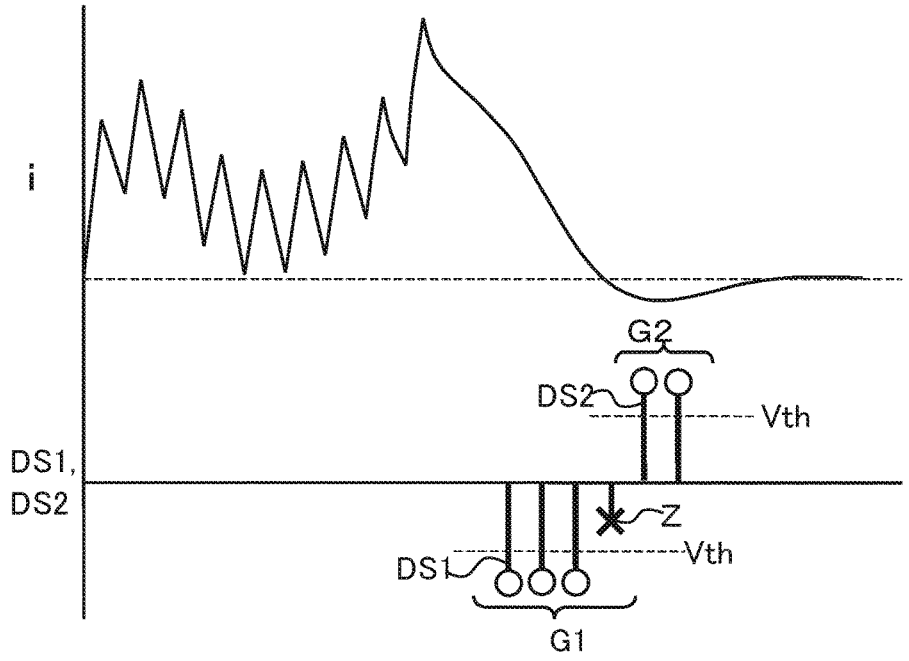
Figures 2, 19:
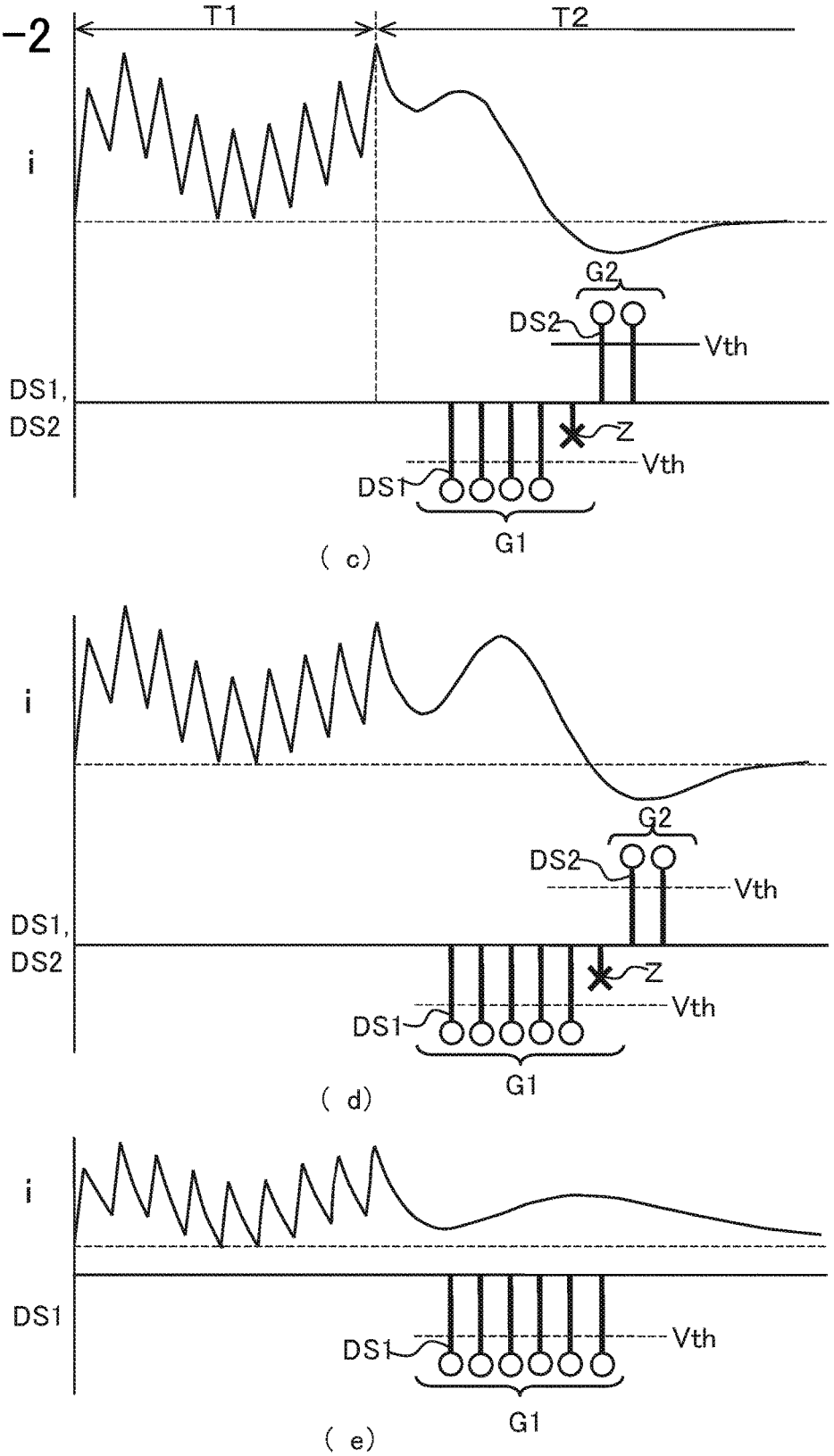

[Description of Rotation Detection Operation According to Fourth Embodiment: FIG. 18 and FIGS. 19]

Next, rotation detection conducted in a fast-forward operation of a step motor according to the fourth embodiment is described with reference to the flowchart of FIG. 18 and timing charts of FIG. 19. The fourth embodiment has a feature that the driving interval TS of the normal pulse SP is determined based on the detection end position of the bell of the counter-electromotive force generated from the step motor.

An electronic watch according to the fourth embodiment has the same configuration as that of the electronic watch according to the first embodiment, and hence the configuration is described with reference to FIG. 1. The description is made based on the premise that the step motor 30 is in a fast-forward operation. Of the respective steps of FIG. 18, the steps within the same operation as that of the flowchart of FIG. 4 according to the first embodiment described above are denoted by like reference symbols, and a detailed description thereof is omitted.

In FIG. 18, the normal pulse SP is generated from the normal pulse generator circuit 5, and is supplied to the step motor 30 to drive the step motor 30 (Step S1).

Subsequently, in order to detect the bell, the first detection pulse generator circuit 11 outputs six first detection pulses DP1 as the first detection segment G1, and the first detection determination circuit 41 determines whether or not two first detection signals DS1 have been detected with the first two first detection pulses DP1 (Step S81). In this case, when the determination is positive (the first two signals have been detected), the procedure advances to Step S82. When the determination is negative (there is no such detection), the rotation of the rotor 31 is determined to have failed, and the procedure advances to Step S7.

When the determination is negative in Step S81, there is a probability that the rotation of the rotor 31 is maintaining little momentum and the dummy has appeared as illustrated in FIG. 13($a$), and hence, instead of advancing to Step S7, although not shown, the operation may proceed to the low-speed detection mode to add processing for carrying out dummy detection, bell detection, and well detection so as to handle the slow rotation of the rotor 31.

Subsequently, when the determination is positive in Step S81, the first detection determination circuit 41 determines whether or not the bell has been detected by the first detection signal DS1 with the third piece of the first detection pulse DP1 (Step S82). In this case, when the determination is negative (there is no such detection), the output of the first detection pulse DP1 is stopped at the fourth piece, and the procedure advances to Step S83. When the determination is positive (the bell has been detected), the procedure advances to Step S85.

Subsequently, when the determination is negative in Step S82, in order to proceed to the detection of the well, the rotation detector circuit 40 notifies the second detection pulse generator circuit 12 to that effect, the second detection pulse generator circuit 12 outputs two second detection pulses DP2 as the second detection segment G2, and the second detection determination circuit 42 determines whether or not two second detection signals DS2 have been detected with the two second detection pulses DP2 (Step S83). In this case, when the determination is positive (two signals have been detected), the procedure advances to Step S84. When the determination is negative (there is no such detection), the rotation of the rotor 31 is determined to have failed, and the procedure advances to Step S7.

Subsequently, when the determination is positive in Step S83, the frequency selection circuit 4 sets, for example, (driving interval TS of the normal pulse SP)=(approximately 7.0 mS) (Step S84). Then, the processing returns from Step S84 to Step S1, and the subsequent normal pulse SP is output after the lapse of approximately 7.0 mS.

Then, in the same manner, in FIG. 18, when the determination is negative in Step S85 and when the determination is positive in Step S86, for example, (driving interval TS of the normal pulse SP)=(approximately 7.5 mS) is set in Step S87. Further, when the determination is negative in Step S88 and when the determination is positive in Step S89, for example, (driving interval TS of the normal pulse SP)=(approximately 8.5 mS) is set in Step S90. Further, when the determination is negative in Step S91 and when the determination is positive in Step S92, for example, (driving interval TS of the normal pulse SP)=(approximately 9.5 mS) is set in Step S93.

Further, as illustrated in FIG. 18, when the determination is negative in Steps S86, S89, and S92, or when the determination is positive in Step S91, the rotation of the rotor 31 is determined to have failed, and the procedure advances to Step S7. The processing of Step S7 and the subsequent steps is the same as that of the flow of the first embodiment illustrated in FIG. 4, and hence a description thereof is omitted.

Next, an operation timing of the fourth embodiment is described with reference to timing charts of FIG. 19. FIG. 19 are schematic illustrations of examples of the current waveform i due to the counter-electromotive force generated from the step motor 30 and the first and second detection signals DS1 and DS2 generated in the input terminals C1 and C2 of the step motor 30. For the sake of convenience, FIG. 19 are divided into FIG. 19-1 that contains FIG. 19($a$) and FIG. 19($b$) and FIG. 19-2 that contains FIG. 19($c$), FIG. 19($d$), and FIG. 19($e$).

In this case, the timing chart of FIG. 19($a$) relates to a case where the determination is positive in Step S81, the determination is negative in Step S82, the determination is positive in Step S83, and the driving interval TS of the normal pulse SP is set to, for example, approximately 7.0 mS. That is, it is indicated that the first two first detection signals DS1 have been detected within the first detection segment G1 after the end of the driven period T1 and after the start of the damped period T2, which is followed by a failure in the detection of the third piece of the first detection signal DS1, and the two second detection signals DS2 have been detected within the succeeding second detection segment G2 (the first two pieces of DS1 are indicated by "○", the third piece thereof is indicated by "x", and the two pieces of DS2 are indicated by "○").

In this case, a timing at which the first detection signal DS1 stops being detected, that is, a detection end position Z of the bell falls in the third piece of the first detection signal DS1, and the well has been successfully detected. Therefore, it is determined that the rotation of the rotor 31 is relatively fast, and the driving interval TS of the normal pulse SP is set to approximately 7.0 mS.

The timing chart of FIG. 19(*b*) relates to a case where the determination is positive insteps S81 and S82, the determination is negative in Step S85, the determination is positive in Step S86, and the driving interval TS of the normal pulse SP is set to, for example, approximately 7.5 mS. That is, it is indicated that the first two first detection signals DS1 have been detected within the first detection segment G1 after the end of the driven period T1 and after the start of the damped period T2, which is followed by detection of the third piece of the first detection signal DS1 and a failure in the detection of the subsequent fourth piece thereof, and the two second detection signals DS2 have been detected within the succeeding second detection segment G2 (the first three pieces of DS1 are indicated by "○", the fourth piece thereof is indicated by "x", and two pieces of DS2 are indicated by "○").

In this case, the detection end position Z of the bell falls in the fourth piece of the first detection signal DS1, and the well has been successfully detected. Therefore, it is determined that the rotation of the rotor 31 is a moderate speed, and the driving interval TS of the normal pulse SP is set to approximately 7.5 mS.

The timing chart of FIG. 19(*c*) relates to a case where the determination is positive in Steps S81, S82 and S85, the determination is negative in Step S88, the determination is positive in Step S89, and the driving interval TS of the normal pulse SP is set to, for example, approximately 8.5 mS. That is, it is indicated that the first two first detection signals DS1 have been detected within the first detection segment G1 after the end of the driven period T1 and after the start of the damped period T2, which is followed by detection of the third and fourth pieces of the first detection signal DS1 and a failure in the detection of the fifth piece thereof, and the two second detection signals DS2 have been detected within the succeeding second detection segment G2 (the first four pieces of DS1 are indicated by "○", the fifth piece thereof is indicated by "x", and two pieces of DS2 are indicated by "○").

In this case, the detection end position Z of the bell falls in the fifth piece of the first detection signal DS1, and the well has been success fully detected. Therefore, it is determined that the rotation of the rotor 31 is relatively slow, and the driving interval TS of the normal pulse SP is set to approximately 8.5 mS.

The timing chart of FIG. 19(*d*) relates to a case where the determination is positive in Steps S81, S82, S85, and S88, the determination is negative in Step S91, the determination is positive in Step S92, and the driving interval TS of the normal pulse SP is set to, for example, approximately 9.5 mS. That is, it is indicated that the first two first detection signals DS1 have been detected within the first detection segment G1 after the end of the driven period T1 and after the start of the damped period T2, which is followed by detection of the third, fourth and fifth pieces of the first detection signal DS1 and a failure in the detection of the sixth piece thereof, and the two second detection signals DS2 have been detected within the succeeding second detection segment G2 (the first five pieces of DS1 are indicated by "○", the sixth piece thereof is indicated by "x", and two pieces of DS2 are indicated by "○").

In this case, the detection end position Z of the bell falls in the sixth piece of the first detection signal DS1, and the well has been success fully detected. Therefore, it is determined that the rotation of the rotor 31 is relatively slow, and the driving interval TS of the normal pulse SP is set to approximately 9.0 mS.

The timing chart of the timing chart of FIG. 19(*e*) is an example of a case where the rotation of the rotor 31 is determined to have failed, and relates to a case where the determination is positive in Step S91. That is, it is indicated that the first two first detection signals DS1 have been detected within the first detection segment G1 after the end of the driven period T1 and after the start of the damped period T2, and then all the third, fourth, fifth, and sixth pieces of the first detection signal DS1 have been detected (all six pieces of DS1 are indicated by "○").

In this case, the detection end position Z of the bell cannot be detected because the first detection signal DS1 has been detected up to the sixth piece, and hence it is determined that the rotor 31 has failed to rotate.

In the flowchart of FIG. 18, the six first detection pulses DP1 are collectively output as the first detection segment G1 in Step S81, but the detection segment may be split to carry out processing for outputting the first detection pulses DP1 in order. That is, although not shown, there may be carried out processing for splitting the first detection segment G1 into a first segment G1*a* to a first segment G1*e*, conducting the determination by outputting the first two pieces of the first detection pulse DP1 within the first segment G1*a*, conducting, when the determination is positive, the determination by outputting the third piece of the first detection pulse DP1 as the first segment G1*b* in Step S82, further conducting, when the determination is positive, the determination by outputting the fourth piece of the first detection pulse DP1 as the first segment G1*c* in Step S85, and the like. In this case, internal processing of the rotation detector circuit 40 is different, but is the same as that of the timing charts illustrated in FIG. 19 in terms of operation.

Further, as described above, in the fourth embodiment, the rotation detector circuit 40 notifies the second detection pulse generator circuit 12 that the determination is negative as a result of the detection determination by the first detection signal DS1, and the second detection pulse generator circuit 12 generates the second detection pulse DP2 at a timing after the detection by the first detection signal DS1 is determined to be negative. That is, as illustrated in FIG. 19, the first detection pulse DP1 and the second detection pulse DP2 are independent of each other, and the second detection pulse generator circuit 12 generates the second detection pulse DP2 after the detection by the first detection signal DS1 is determined to be negative, but the present invention is not limited thereto. That is, the first detection pulse DP1 and the second detection pulse DP2 both cause the output terminals O1 and O2 of the driver circuit 20 to both become open, and hence the first detection pulse DP1 with which the determination by the first detection signal DS1 is negative may serve as the first pulse of the second detection pulse DP2. With such a configuration, the second detection signal DS2 can be detected from the timing at which the detection by the first detection signal DS1 is determined to be negative, which eliminates the loss of time.

As described above, according to the fourth embodiment, the detection end position Z of the bell is detected based on the first detection pulse DP1 within the first detection segment G1 for detecting the bell, and the driving interval TS of the normal pulse SP is determined based on the detection end position Z. Therefore, the driving interval TS can be determined quickly after the end of the bell, and it is also possible to support a speedup of the rotation detection. With this configuration, even during the high-speed rotation of the step motor 30, the rotation detection can be conducted without a delay in the rotation state, which allows the rotation detection to be conducted with high precision during the high-speed rotation.

Further, the rotation state of the rotor 31 is grasped based on the detection end position Z of the bell. Therefore, even when there is a great change in the shape of the bell, that is, even when there is a great change in the rotation state of the rotor 31 as illustrated in FIG. 19(*a*) to FIG. 19(*d*), a detection error due to the change can be prevented, and it is possible to provide an electronic watch including high-precision rotation detection means having a wide rotation detection range.

The rotation detection operation described in the fourth embodiment can be applied not only during the fast-forward operation but also to other times including during hand movement, for example, during a normal hand movement operation. The rotation detection operation according to this application example is described with reference to the flowchart of FIG. 20 and the timing chart of FIG. 21. As the same feature as that of the fourth embodiment, this application example is configured to output the second detection pulse DP2 within the second detection segment when the detection by the first detection signal DS1 within the first segment is determined to be negative. The driving interval of the normal pulse SP used in this case is equal to a hand movement interval at the time of the normal hand movement operation, and does not vary depending on the detection result. The electronic watch according to this application example has the same configuration as that of the electronic watch according to the fourth embodiment, and this application example is also the same as the fourth embodiment in that steps having the same operation as that of the above-mentioned flowchart of the first embodiment illustrated in FIG. 4 among respective steps within the flowchart illustrated in FIG. 20 are denoted by like reference symbols, and that the timing chart illustrated in FIG. 21 has the same structure as that of the timing charts (FIG. 5 and FIG. 6) according to the first embodiment described above.

Figure 20:
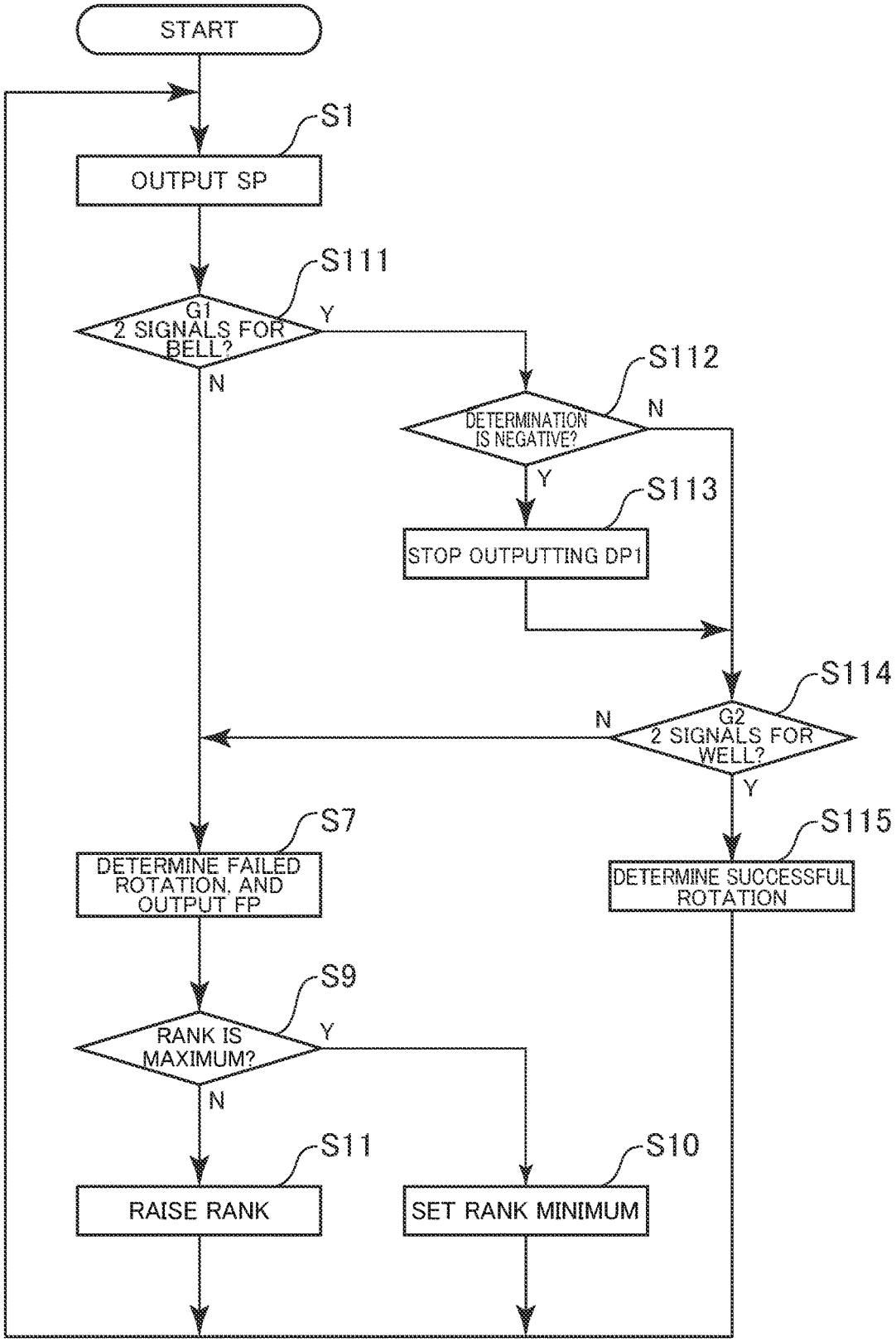
FIG. 20 is a flowchart for illustrating a rotation detection operation for the electronic watch according to an application example of the fourth embodiment of the present invention.

In FIG. 20, the normal pulse SP is generated from the normal pulse generator circuit 5, and is supplied to the step motor 30 to drive the step motor 30 (Step S1).

Subsequently, in order to detect the bell, the first detection pulse generator circuit 11 outputs, as the first detection segment G1, the first detection pulse DP1 a predetermined number of times, for example, six pieces as an upper limit. The first detection determination circuit 41 determines whether or not two first detection signals DS1 have been detected (Step S111). In this case, when the determination is negative (there is no such detection), the rotation of the rotor 31 is determined to have failed, and the procedure advances to Step S7.

When the determination is positive in Step S111, the first detection pulse generator circuit 11 keeps outputting the first detection pulse DP1 unless the number of outputs of the first detection pulse DP1 has reached the upper limit, and the first detection determination circuit 41 determines whether or not the detection by the first detection signal DS1 has been determined to be negative (there is no such detection) (Step S112). When the determination is positive in Step S112, the first detection segment G1 is ended, and the first detection pulse generator circuit 11 is caused to stop outputting the first detection pulse (Step S113).

When the output of the first detection pulse is stopped (Step 113), or when the number of times that the first detection pulse has been generated has reached the upper limit before the detection by the first detection signal DS1 been determined to be negative (there is no such detection) (Step 112: N), in order to proceed to the detection of the well, the rotation detector circuit 40 notifies the second detection pulse generator circuit 12 to that effect, and the second detection pulse generator circuit 12 outputs two second detection pulses DP2 as the second detection segment G2. The second detection determination circuit 42 detects whether or not two second detection signals DS2 have been detected with the two second detection pulses DP2 (Step S114). In this case, when the determination is positive (two signals have been detected), the procedure advances to Step S115 to determine that the rotation of the rotor 31 is successful. When the determination is negative (there is no such detection), the rotation of the rotor 31 is determined to have failed, and the procedure advances to Step S7.

The processing of Step S7 and the subsequent steps is the same as that of the flow of the first embodiment illustrated in FIG. 4, and a description thereof is omitted. The processing conducted when the rotation is determined to be successful (Step S115) does not directly relate to the description of the present invention and is therefore omitted, but appropriate processing may be conducted. For example, when the rotation with the same duty cycle is determined to be successful at predetermined times, the rank of the duty cycle of the normal pulse SP may be, for example, lowered. In any case, the processing is returned to Step S1 with the hand movement interval at the time of the normal hand movement operation, and the normal pulse SP is output.

Figure 21:
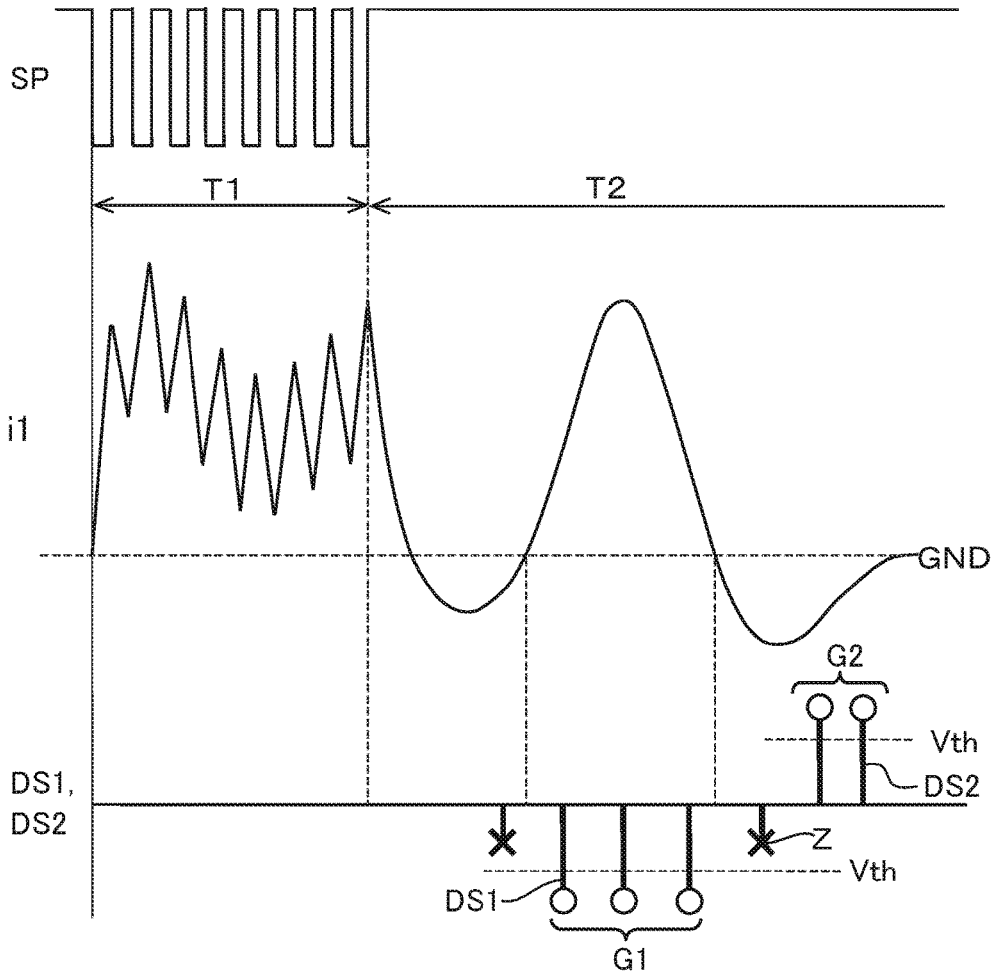
FIG. 21 is a timing chart for illustrating the rotation detection operation for the electronic watch according to an application example of the fourth embodiment of the present invention.

An operation timing according to this application example is described with reference to the timing chart of FIG. 21. In this case, the timing chart of FIG. 21 relates to a case where the determination is positive in Step S111 when the detection of two first detection signals DS1 is successful, when the determination is further positive in Step S112 when the detection of the first detection signal DS1 has failed, when the determination is positive in Step S114 when two second detection signals DS2 have been detected, and the rotation is determined to be successful. As an example of such a case, FIG. 21 indicates that the first piece of the first detection signal DS1 has not been detected, the subsequent three pieces have been detected, and the fifth piece has not been detected within the first detection segment G1 after the end of the driven period T1 and after the start of the damped period T2, and that two second detection signals DS2 have been detected within the succeeding second detection segment (the first and last of DS1 are indicated by "x", three pieces therebetween are indicated by "○", and two pieces of DS2 are indicated by "○").

In this case, the first detection signal DS1 has not been detected with the first piece of the first detection pulse DP1, but two first detection signals DS1 have been detected with the following second and third pulses, and hence the determination is positive in Step S111. At this time, the number of outputs of the first detection pulse DP1 has not reached the upper limit of six, and hence the first detection segment G1 is continued to further output the first detection pulse DP1. The fourth piece of the first detection signal DS1 has been detected, and hence the fifth piece of the first detection pulse DP1 is output. The fifth piece of the first detection signal DS1 has not been detected, and hence this position is set as the detection end position Z. The first detection segment G1 is ended at the detection end position Z, and the output of the first detection pulse DP1 is stopped (Steps S112 and S113).

Two second detection signals DS2 have been detected with two second detection pulses DP2 within the succeeding second detection segment G2, and the rotation of the rotor 31 is determined to be successful (Steps S114 and S115).

In this manner, also during the normal hand movement operation, even when the shape of the bell is greatly changed by proceeding to the second detection segment G2 based on the detection end position Z, that is, even when there is a great change in the rotation state of the rotor 31, a detection error due to the change can be prevented, and it is possible to provide an electronic watch including high-precision rotation detection means having a wide rotation detection range.

Figure 22:
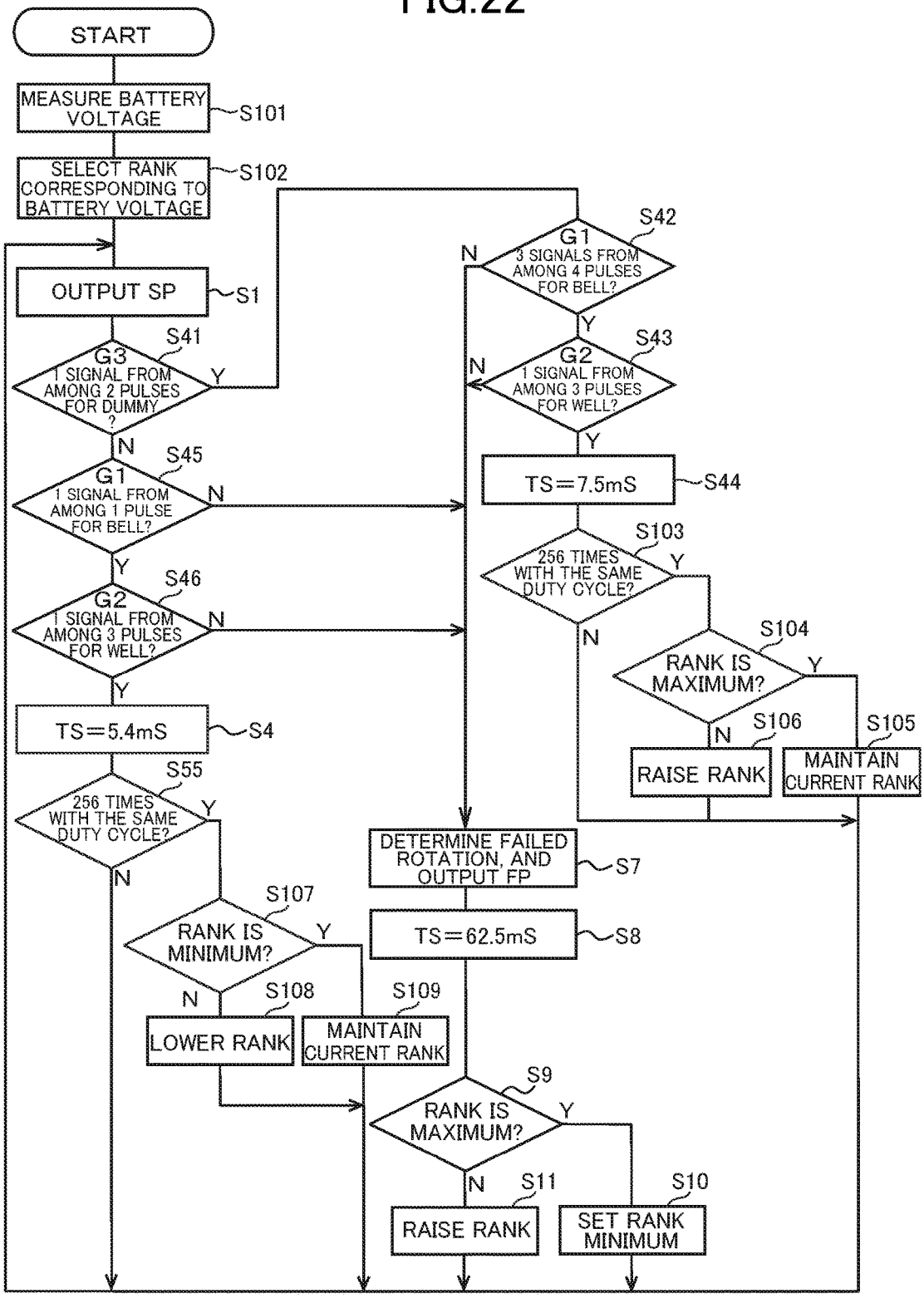
FIG. 22 is a flowchart for illustrating a rotation detection operation for the electronic watch according to a fifth embodiment of the present invention.

[Description of Rotation Detection Operation According to Fifth Embodiment: FIG. 22]

Next, rotation detection operation conducted in a fast-forward operation of a step motor according to a fifth embodiment of the present invention is described with reference to the flowchart of FIG. 22. An electronic watch according to the fifth embodiment has a feature that the rank of the duty cycle can be adjusted depending on the number of outputs of the normal pulse SP, which is described below in detail. The flowchart of FIG. 22 is analogous to the flowchart of FIG. 14 used for the description of the rotation detection operation for the electronic watch according to the modification example of the third embodiment, and hence only steps added to the above-mentioned flow or changed steps are newly described. Like steps are denoted by like reference symbols, and detailed descriptions thereof are omitted in order to avoid duplication. The electronic watch according to the fifth embodiment has the same basic configuration as the configuration of the third embodiment illustrated in FIG. 11, and hence a description thereof is omitted.

First, the power supply voltage detector circuit 50 detects the power supply voltage of the electronic watch (Step S101). Then, the rank of the normal pulse SP corresponding to the detected power supply voltage is selected (Step S102). In this manner, the power supply voltage of the electronic watch is first detected, and an optimal rank is selected, to thereby enable the step motor 30 to be driven with minimum power consumption while increasing the speed of the hand movement immediately after the start of the hand movement.

After that, the normal pulse generator circuit 5 outputs the normal pulse SP (Step S1) to drive the step motor 30. When one third detection signal DS3 is detected from among two third detection pulses DP3 (Step S41), when three first detection signals DS are detected from among four first detection pulse DP1 (Step S42), and when one second detection pulses DP2 is detected from among three second detection signals DS2, the procedure advances to Step S44 of FIG. 22. Then, the rotation detector circuit 40 uses the frequency selection signal P5 to instruct the frequency selection circuit 4 to select such a frequency as to satisfy (driving interval TS)=(approximately 7.5 mS) (Step S44). This is because it is determined that (driving interval TS)=(approximately 7.5 mS) slower than (driving interval TS)=(approximately 5.4 mS) being the highest speed is to be set because the rotation of the step motor 30 is slow due to some factor.

Subsequently, it is determined whether or not the number of outputs of the normal pulse SP having the same duty cycle, which is counted by the frequency counting circuit 60, has reached 256 (Step S103). When the determination is negative in Step S103, that is, when the number of outputs of the normal pulse SP having the same duty cycle has not reached 256, the processing of from Step S1 to Step S103 is continued without a change being made to the rank of the normal pulse SP.

Meanwhile, when the determination is positive in Step S103, that is, when the number of outputs of the normal pulse SP having the same duty cycle, which is counted by the frequency counting circuit 60, has reached 256, the rotation detector circuit 40 determines whether or not the rank of the normal pulse SP is maximum (Step S104). When the determination is negative in Step S104, that is, when there is room to raise the rank, the rank is raised. After the rank of the normal pulse SP is raised, when the determination is negative in Step S41, when the determination is positive in Step S45, and when the determination is positive in Step S46, (driving interval TS of the normal pulse SP)=(approximately 5.4 mS) is set.

In this manner, in the modification example of the third embodiment described with reference to FIG. 14, low consumption is prioritized to inhibit the operation to proceed to the highest-speed rotation state (approximately 5.4 mS) once the medium-level rotation state (approximately 7.5 mS) is set even when the battery voltage has surplus power to conduct the fast-forward drive at the highest speed, while in the fifth embodiment, the operation is allowed to proceed to the highest-speed rotation state (approximately 5.4 mS) by raising the rank when the number of outputs of the normal pulse having the same duty cycle has reached a predetermined number. Therefore, it is possible to achieve the speedup of the fast forward.

Meanwhile, when the determination is positive in Step S104, that is, when the rank of the normal pulse SP is maximum and when there is no more room to raise the rank, the processing is continued with the current rank (Step S105). At this time, the generation of the normal pulse SP having (driving interval TS)=(approximately 7.5 mS) is continued.

Next, the case where the driving interval TS is set to approximately 5.4 mS being the highest speed is described. In Step S55 of FIG. 22, it is determined whether or not the number of outputs of the normal pulse SP having the same duty cycle, which is counted by the frequency counting circuit 60, has reached 256. When the determination is negative in Step S55, that is, when the number of outputs of the normal pulse SP having the same duty cycle has not reached 256, the procedure returns to Step S1 to continue the processing of from Step S1 to Step S55 without a change being made to the rank of the normal pulse SP.

Meanwhile, when the determination is positive in Step S55, that is, when the number of outputs of the normal pulse SP having the same duty cycle has reached 256, the rotation detector circuit 40 determines whether or not the rank of the normal pulse SP is minimum (Step S107). When the determination is negative in Step S107, that is, when there is room to lower the rank, the rank is lowered. In this manner, when the rank is not minimum, the rank is lowered to the minimum duty cycle that can maintain the highest speed, to thereby be able to suppress the power consumption.

As described above, the electronic watch according to the fifth embodiment is designed so as to optimize a balance between the speedup of the step motor 30 and the reduction in the power consumption. In particular, the fifth embodiment is suitable for application to a solar-powered clock exhibiting rapid fluctuations in the power supply voltage.

The block diagrams, the flowcharts, the timing charts, and the like used for illustrating the respective embodiments of the present invention are not intended to limit the present invention, and can be changed arbitrarily as long as the gist of the present invention is satisfied. For example, no limitations are imposed on the number of outputs of the detection pulse, the detection period, the number of times of detection, or the like within each of the detection segments, and can be changed arbitrarily based on the performance of the step motor and the specifications of the electronic watch.

The count of the detection signals conducted within each of the detection segments, which is described in each embodiment, is determined by counting a total sum of the detection signals. That is, irrespective of whether the detection pulses are detected consecutively or non-consecutively within each of the detection segments, the determination is positive as long as a predetermined number of times of detection (total sum) has been reached. For example, in the second embodiment, three first detection signals DS1 are detected consecutively from the second piece within the first segment first half G1*a* illustrated in FIG. 10(*a*), but the present invention is not limited to such consecutive detection, and the determination is positive even when, for example, three signals in total of the first, third, and fourth pieces are detected.

Further, in the case where the determination is positive when one detection pulse is detected within each of the detection segments, the detection pulse in any position within the segment may be detected. For example, in the second embodiment, the determination is positive when the third piece of the second detection signal DS2 is detected within the second segment first half G2*a* illustrated in FIG. 10(*a*), but the present invention is not limited thereto, and the first piece or second piece of the second detection signal DS2 may be detected. Further, the present invention is not limited to only the fast-forward operation of the step motor, and can also be applied to the rotation detection of the rotor in, for example, the normal hand movement operation conducted every minute.

The invention claimed is:

1. An electronic watch, comprising:

a step motor;

a normal pulse generator circuit configured to output a normal pulse for driving the step motor;

a detection pulse generator circuit configured to output, after the step motor has been driven with the normal pulse, a detection pulse for detecting whether or not the step motor has been rotated;

a pulse selection circuit configured to selectively output the normal pulse and the detection pulse;

a driver circuit configured to load a pulse output from the pulse selection circuit on the step motor;

a rotation detector circuit configured to input a detection signal generated from the detection pulse, and to determine whether or not the step motor has been rotated; and a frequency selection circuit configured to determine a driving interval of the normal pulse, wherein:

the detection pulse generator circuit is configured to output the detection pulse so as to divide the detection pulse into predetermined segments; and the rotation detector circuit is configured to conduct rotation detection separately in each detection segment, said detection segments corresponding to the predetermined segments, and to instruct the frequency selection circuit to select a frequency corresponding to the detection segment in which the detection signal has been detected.

2. The electronic watch according to claim 1, wherein the rotation detector circuit is configured to conduct the rotation detection separately in each of a plurality of the detection segments, and to change a detection condition for one of the detection segments based on a detection result of another one of the detection segments.

3. The electronic watch according to claim 2, wherein the detection condition for the detection segment comprises at least any one of a segment width of the detection segment or a number of detection signals to be detected within the detection segment.

4. The electronic watch according to claim 1, wherein:

the normal pulse generator circuit is configured to be able to output a plurality of the normal pulses having different driving forces; and the rotation detector circuit is configured to select the driving force of the normal pulse based on a determination result as to whether or not the step motor has been rotated, and to instruct the normal pulse generator circuit on a selection thereof.

5. The electronic watch according to claim 4, wherein the rotation detector circuit is configured to instruct the frequency selection circuit on the frequency corresponding to the normal pulse that has been selected and instructed.

6. The electronic watch according to claim 4, wherein the rotation detector circuit is configured to change a detection condition within each of the detection segments so as to correspond to the normal pulse that has been selected and instructed.

7. The electronic watch according to claim 4, further comprising a frequency counting circuit configured to count a number of outputs of the normal pulse, wherein the rotation detector circuit is configured to select, when the number of outputs of the normal pulse having a specific driving force has reached a predetermined number, the specific driving force so as to change the specific driving force of the normal pulse.

8. The electronic watch according to claim 7, wherein the rotation detector circuit is configured to:

change the driving force of the normal pulse so as to reduce the driving force of the normal pulse when the driving interval of the normal pulse determined by the frequency selection circuit is relatively short; and change the driving force of the normal pulse so as to increase the driving force of the normal pulse when the driving interval of the normal pulse determined by the frequency selection circuit is relatively long.

9. The electronic watch according to claim 1, wherein:

the detection pulse generator circuit comprises:

a first detection pulse generator circuit configured to generate a first detection pulse for detecting a current waveform, which is generated first on a side different from a side of the normal pulse due to a counter-electromotive force generated by the driving with the normal pulse; and a second detection pulse generator circuit configured to generate a second detection pulse for detecting a current waveform, which is generated on the same side as the side of the normal pulse after the current waveform was first generated on the side different from the side of the normal pulse due to the counter-electromotive force generated by the driving with the normal pulse; and the rotation detector circuit is configured to instruct the frequency selection circuit based on at least any one of a first detection signal generated from the first detection pulse or a second detection signal generated from the second detection pulse.

10. The electronic watch according to claim 9, wherein:

the detection pulse generator circuit further comprises a third detection pulse generator circuit configured to generate a third detection pulse for detecting a current waveform, which is generated on the same side as the side of the normal pulse immediately after the normal pulse due to the counter-electromotive force generated by the driving with the normal pulse; and the rotation detector circuit is configured to instruct the frequency selection circuit based on at least any one of the first detection signal, the second detection signal, or a third detection signal generated from the third detection pulse.

11. The electronic watch according to claim 1, further comprising a factor detection circuit configured to specify, through factor detection, at least any one of a frequency determined by the frequency selection circuit or a driving force of the normal pulse output by the normal pulse generator circuit.

12. The electronic watch according to claim 11, wherein the factor detection circuit comprises a power supply voltage detector circuit.

13. The electronic watch according to claim 1, further comprising a correction pulse generator circuit configured to generate a correction pulse, and to output the correction pulse to the pulse selection circuit, wherein the rotation detector circuit is configured to:

instruct the pulse selection circuit to output the correction pulse when the step motor is determined to have failed to rotate; and instruct the frequency selection circuit on such a frequency as to enable the correction pulse to be output.

14. The electronic watch according to claim 9, wherein:

the rotation detector circuit is configured to detect a timing at which the first detection signal stops being detected after the first detection signal generated from the first detection pulse has been detected, and to notify the second detection pulse generator circuit of the timing; and the second detection pulse generator circuit is configured to generate the second detection pulse after the timing.

15. An electronic watch, comprising:

a step motor;

a normal pulse generator circuit configured to output a normal pulse for driving the step motor;

a detection pulse generator circuit configured to output, after the step motor has been driven with the normal pulse, a detection pulse for detecting whether or not the step motor has been rotated;

a pulse selection circuit configured to selectively output the normal pulse and the detection pulse;

a driver circuit configured to load a pulse output from the pulse selection circuit on the step motor; and a rotation detector circuit configured to input a detection signal generated from the detection pulse, and to determine whether or not the step motor has been rotated, wherein:

the detection pulse generator circuit comprises:

a first detection pulse generator circuit configured to generate a first detection pulse for detecting a current waveform, which is generated first on a side different from a side of the normal pulse due to a counter-electromotive force generated by the driving with the normal pulse; and a second detection pulse generator circuit configured to generate a second detection pulse for detecting a current waveform, which is generated on the same side as the side of the normal pulse after the current waveform was first generated first on the side different from the side of the normal pulse due to the counter-electromotive force generated by the driving with the normal pulse;

the rotation detector circuit is configured to detect a timing at which a first detection signal stops being detected after the first detection signal generated from the first detection pulse has been detected, and to notify the second detection pulse generator circuit of the timing; and the second detection pulse generator circuit is configured to generate the second detection pulse after the timing.

* * * * *